US008350714B2

(12) United States Patent
Trim

(10) Patent No.: US 8,350,714 B2
(45) Date of Patent: Jan. 8, 2013

(54) COLLISION ALERT SYSTEM

(76) Inventor: Matthew Ian Trim, Lakewood, CO (US)

( * ) Notice: Subject to any disclaimer, the term of this patent is extended or adjusted under 35 U.S.C. 154(b) by 267 days.

(21) Appl. No.: 12/945,082

(22) Filed: Nov. 12, 2010

(65) Prior Publication Data

US 2011/0109469 A1 May 12, 2011

Related U.S. Application Data

(60) Provisional application No. 61/260,404, filed on Nov. 12, 2009.

(51) Int. Cl.
*G08B 21/00* (2006.01)

(52) U.S. Cl. ..... 340/686.6; 340/545.1; 340/545.6; 318/480; 49/25

(58) Field of Classification Search ..... 340/686.6, 340/686.1, 545.1, 545.2, 545.3, 545.6, 545.9, 340/547, 551, 467, 480; 49/25, 27, 31, 334, 49/463; 318/480, 450, 460, 467, 455
See application file for complete search history.

(56) References Cited

U.S. PATENT DOCUMENTS

| | | | | |
|---|---|---|---|---|
| 5,861,806 | A | 1/1999 | Vories et al. | |
| 5,963,000 | A * | 10/1999 | Tsutsumi et al. | 318/480 |
| 6,292,100 | B1 | 9/2001 | Dowling | |
| 6,304,178 | B1 * | 10/2001 | Hayashida | 340/545.1 |
| 6,970,085 | B2 * | 11/2005 | Okabe et al. | 340/545.6 |
| 7,318,298 | B2 * | 1/2008 | Marsden et al. | 49/57 |
| 2008/0022596 | A1 | 1/2008 | Boerger et al. | |

* cited by examiner

*Primary Examiner* — Anh V La
(74) *Attorney, Agent, or Firm* — Ash Tankha; Lipton, Weinberger & Husick

(57) ABSTRACT

A method and system for generating an alert for a possible collision between objects and a swinging barrier is provided. The method and system provides multiple sensing devices, a control unit, and multiple indicator devices at predetermined areas proximal to the swinging barrier. The sensing devices and the control unit electronically communicate with the indicator devices. The sensing devices are configured to establish sensing zones proximal to the swinging barrier. The sensing devices detect presence of one or more of stationary objects, approaching objects, and receding objects in the established sensing zones. The control unit tracks and differentiates the presence of the stationary objects, approaching movements of the approaching objects, and receding movements of the receding objects in the established sensing zones, and generates an alert signal. The indicator devices selectively indicate a possible collision on receiving the alert signal from the control unit.

22 Claims, 41 Drawing Sheets

| Z1 | Z2 | Y | RED | FLRED | BUZZ |
|---|---|---|---|---|---|
| 0 | 0 | 0 | 0 | 0 | 0 |
| 1 | 0 | 1 | 0 | 0 | 0 |
| 1 | 1 | 1 | 1 | 0 | 0 |
| 1 | 1 | 1 | 0 | 1 | 1 |

| Z1 | Z2 | Y | RED | FLRED | BUZZ |
|---|---|---|---|---|---|
| 0 | 0 | 0 | 0 | 0 | 0 |
| 1 | 0 | 1 | 0 | 0 | 0 |
| 1 | 1 | 1 | 1 | 0 | 0 |
| 1 | 1 | 1 | 0 | 1 | 1 |

| Z1 | Z2 | Y | RED | FLRED | BUZZ |
|---|---|---|---|---|---|
| 0 | 0 | 0 | 0 | 0 | 0 |
| 1 | 0 | 1 | 0 | 0 | 0 |
| 1 | 1 | 1 | 1 | 0 | 0 |
| 1 | 1 | 1 | 0 | 1 | 1 |

```
//#define DEBUGX
#include <mega48.h>
//#include "delay.h"
#include "defines.h"
#include "prototypes.h"

#ifdef DEBUGX
#include "stdio.h"
#endif

unsigned char  eeprom buzzer_state = 0;
volatile unsigned char z1_event = 0, z2_event = 0;
unsigned char transition_event = 0, receding_event = 0, decide_event = 0;
unsigned int no_motion_count = 0, decide_event_count = 0;
unsigned int recede_time = 0, transition_time = 0;
volatile unsigned char MOTION_Z1 = 0;
unsigned char eeprom RECEDING_EVENT_TIME = 5;// 5 * 100 mS

interrupt [TIM1_OVF] void timer1_ovf_isr(void)
{
 static unsigned int d, i = 0, count = 0;
 TCNT1H=0xff;
 TCNT1L=0xeb;// 0xffe8--->0xffff == 183us ( 2.730 kHz for buzzer)

 if( buzzer_state == 0)
  BUZZER_HIGH;

 if( ++count >= 546)
 {
 count = 0;
  #ifdef DEBUGX
     if(!( ++d % 10))
     {
        printf(" -%d", d/10);
        if( receding_event == 1)
           printf("r");
        if( transition_event == 1)
           printf("t");
        printf("%d-", MOTION_Z1);
     }
  #endif
```

FIG. 21A

```
if( MOTION_Z1 == 1 &&( receding_event != 1 &&  transition_event != 1)) // if a
motion is detected in the Zone 1, that is, the outer zone
  {
    // if the motion is not sensed in z1 within 5 s
    if(++no_motion_count >= NO_MOTION_DETECTED_TIME)
    {
      DIM_YELLOW_LED_LOW; // make yellow led low
      MOTION_Z1 = 0;
      decide_event_count = 0;
      decide_event = 0;
      YELLOW_LED_LOW;
      #ifdef DEBUGX
        printf("\r\n no motion");
      #endif
    }
  }
  // if motion is sensed in Zone 1, then wait for the motion to be sensed
  //in the Zone 2 i.e the inner zone
  if( decide_event == 1 &&( receding_event != 1 &&  transition_event != 1))
  {
    ++decide_event_count;// increment the count every 100 mS
    if( MOTION_Z1 == 2)
    {
      if( decide_event_count <= RECEDING_EVENT_TIME)
      {
        if( z1_event == 1) // if a motion sensed in inner zone( Zone2)
        {
            receding_event = 1;
            #ifdef DEBUGX
            printf("\r\n decided - zzreceding");
          #endif
        }
      }
```

FIG. 21B

```
        else
        {
          decide_event_count = 0;// make decide count 0
          decide_event = 0; // make decide event 0
          z2_event = 0; // make z2 event 0
          z1_event = 0;
          recede_time = 0;// make recede count 0
          transition_time = 0; // make transition count 0
          MOTION_Z1 = 0;
          receding_event = 0;
          transition_event = 0;
          RED_LED_LOW;
        }
      }
      if( MOTION_Z1 == 1)
      {
        if( z2_event == 1) // if a motion is sensed in inner zone( Zone2)
        {
          // if it lesser than 500 mS then it is transition event
          if( decide_event_count >= RECEDING_EVENT_TIME)
           {
             transition_event = 1;
             BUZZER_HIGH;        // // MAKE BUZZER HIGH IF IT IS NOT
DISABLED( SEE MACRO)
             #ifdef DEBUGX
               printf("\r\n decided - transition");
             #endif
           }
          // if it greater than 500 mS then it is receding event
          else
          {
             receding_event = 1;
             #ifdef DEBUGX
               printf("\r\n decided - receding");
             #endif
          }
```

FIG. 21C

```
            decide_event_count = 0;// make decide count 0
            decide_event = 0; // make decide event 0
            z2_event = 0;     // make z2 event 0
            z1_event = 0;
            recede_time = 0;// make recede count 0
            transition_time = 0; // make transition count 0
            MOTION_Z1 = 0;
          }
        }
        if( decide_event_count >= WAIT_TIME && MOTION_Z1 == 0)// if neither
event takes place in the given time
        {
          z1_event = 0;
          z2_event = 0;
          if( MOTION_Z1 == 0)
          {
             DIM_YELLOW_LED_LOW;
             DIM_RED_LED_LOW;
             decide_event = 0;
          }

          recede_time = 0;
          transition_time = 0;
          decide_event_count = 0;
          //MOTION_Z1 = 0;
          #ifdef DEBUGX
                printf("\r\n z1 2 z2 -waitover");
          #endif
        }
    }
```

FIG. 21D

```
// if it is a receding event
if( receding_event == 1)
{
    if( recede_time <= WAIT_TIME)
    {
        z1_event = 0;
        z2_event = 0;
    }
   if( ++recede_time >= WAIT_TIME + 10 )// if it is in recede state
   // for more than 5 s
   {
      // if z1_event or z2_event has occured during this wait time
      if( z2_event == 1 )
      {
        transition_event = 1;   // go 2 transition state
         #ifdef DEBUGX
            printf("\r\n r 2 t ");
         #endif
         BUZZER_HIGH;    // make buzzer high
      }
      else  // else
      {
         #ifdef DEBUGX
            printf("\r\n recede over");
         #endif

      }
      DIM_RED_LED_LOW; //
      DIM_YELLOW_LED_LOW;
      YELLOW_LED_LOW;
      RED_LED_LOW;
      receding_event = 0;
      recede_time = 0;
      transition_time = 0;
      z1_event = 0;
      z2_event = 0;
      MOTION_Z1 = 0;
      #ifdef DEBUGX
         printf("-rout-");
      #endif
      //delay_ms( 100);

   }
}
```

FIG. 21E

```
// if it is a transition event, that is, an approaching movement
if( transition_event == 1)
{
   if( ++i % 2)
      DIM_RED_LED_BLINK; // blink red led
   if( ++transition_time >= WAIT_TIME )
   {
      // if z1_event or z2_event has occurred during this wait time
      if(  z2_event != 1)      // stop transition
      {
         #ifdef DEBUGX
            printf("\r\n transition over.");
         #endif
         transition_event = 0;
         BUZZER_LOW;
         MOTION_Z1 = 0;
      }
      else      // continue transition
      {
         #ifdef DEBUGX
            printf("\r\n transition cont...");
         #endif
         transition_event = 1;

      }
      z1_event = 0;
      z2_event = 0;

      receding_event = 0;
      decide_event = 0;
      transition_time = 0;
      YELLOW_LED_LOW;
      DIM_YELLOW_LED_LOW; // make yellow led low
      DIM_RED_LED_LOW; // make red led low
      RED_LED_LOW;
      //delay_ms( 100);
   }
  }
 }
}
```

FIG. 21F

```
/*****************************************************************
* Function name:interrupt [PCINT2] void pin_change_isr2(void)      *
* Input parameters: // Pin change 16-23 interrupt service routine  *
* Output parameters: NONE                                          *
* Purpose: I/P FRM PIR2 - O/P PIN( RED)                            *
* Returns: NONE                                                    *
*****************************************************************/

interrupt [PCINT2] void pin_change_isr2(void)
{
   //GREEN_LED_BLINK;
}
/*****************************************************************
* Function name:interrupt [PCINT1] void pin_change_isr1(void)      *
* Input parameters: // Pin change 8-14 interrupt service routine   *
* Output parameters: NONE                                          *
* Purpose: I/P FRM PIR2 - LED PIN( RED)                            *
* Returns: NONE                                                    *
*****************************************************************/

interrupt [PCINT1] void pin_change_isr1(void)
{
  if( MOTION_Z1 == 1)
  {
     if( IS_PIR2_LED_HIGH)
     {
        z2_event = 1;
        #ifdef DEBUGX
           printf("- int z2--");
        #endif
        no_motion_count = 0;
        transition_time = 0;
        RED_LED_HIGH;

        if( transition_event == 1)
        {
           z2_event = 0;
        }
        RED_LED_HIGH;
     }
     else{
        RED_LED_LOW;
     }}
```

FIG. 21G

```
    else if(  MOTION_Z1 == 0  && transition_event != 1 && receding_event != 1)
    {
        if( IS_PIR2_LED_HIGH)
        {
            z2_event = 1;
            z1_event = 0;
            #ifdef DEBUGX
            printf("- int z22--");
            #endif
            MOTION_Z1 = 2;
            decide_event_count = 0;
            decide_event = 1;
            RED_LED_HIGH;
        }
        else
        {
            RED_LED_LOW;
        }
    }
    else if( MOTION_Z1 == 0  && transition_event == 1)
    {
        if( IS_PIR2_LED_HIGH)
        {
            z2_event = 0;
            z1_event = 0;
            #ifdef DEBUGX
                printf("- int z22t--");
            #endif
            transition_time = 0;
            RED_LED_HIGH;
        }
        else
        {
            RED_LED_LOW;
        }
    }
}
```

FIG. 21H

```
/*****************************************************************
* Function name: interrupt [PCINT0] void pin_change_isr0(void)      *
* Input parameters: I/P FROM SWITCH                                 *
* Output parameters: NONE                                           *
* Purpose:// Pin change 0-7 interrupt service routine               *
* Processing: See function                                          *
* Returns: NONE*****************************************************/

interrupt [PCINT0] void pin_change_isr0(void)
{
   if( !IS_SWITCH_HIGH) // IS SWITCH PRESSED?
   {
      delay_ms1( 10);   // DEBOUNCE DELAY
      if( !IS_SWITCH_HIGH)// CONFIRM IT IS NOT A SPIKE
      {
         buzzer_state ^= 0x01;// TOGGLE THE BUZZER STATE

         if( buzzer_state == 0x01)// IF BUZZER STATE IS 1
         {
            BUZZER_LOW;     // SWITCH OFF THE BUZZER
            #ifdef DEBUGX
               printf("- bl--");
            #endif

         }
      }
   }
}
```

FIG. 21I

```
/*****************************************************************
* Function name:interrupt [EXT_INT0] void ext_int0_isr(void)      *
* Input parameters: NONE                                          *
* Output parameters: NONE                                         *
* Purpose:// External Interrupt 0 service routine- I/P FROM PIR1 LED *
* Processing: See function                                        *
* Returns: NONE                                                   *
*****************************************************************/

interrupt [EXT_INT0] void ext_int0_isr(void)
{
   if( IS_PIR1_LED_HIGH)// IS O/P FROM PIR1 IC HIGH
   {
      z1_event = 1;    //IT IS A Z1 EVENT
      #ifdef DEBUGX
         printf("-int z1--");
      #endif
      YELLOW_LED_HIGH;
   }
   else
   {
      YELLOW_LED_LOW;
   }
}
/*****************************************************************
* Function name:interrupt [EXT_INT1] void ext_int1_isr(void)      *
* Input parameters: NONE                                          *
* Output parameters: NONE                                         *
* Purpose: // External Interrupt 1 service routine- I/P FROM PIR O/P *
* Processing: See function                                        *
* Returns:NONE                                                    *
*****************************************************************

interrupt [EXT_INT1] void ext_int1_isr(void)
{
 // GREEN_LED_BLINK
   ;
}
```

FIG. 21J

```
/*************************************************************
* Function name:void main( void)                             *
* Input parameters: NONE                                     *
* Output parameters: NONE                                    *
* Purpose: MAIN FLOW                                         *
* Processing: See function                                   *
* Returns: NONE                                              *
*************************************************************/

void main( void)
{
   unsigned int i = 0, diagnostic_mode = 0;
   port_init();  // port initialization
   delay_ms1( 20);
   if( !IS_SWITCH_HIGH)// is s1 switch is press n held for 2 s at Power on
   {
      while( ++i <= 40)
      {
         delay_ms1( 50);
         if( IS_SWITCH_HIGH)  // if the switch is released within 2 s
         {
            diagnostic_mode = 0; // go to normal mode
            #ifdef DEBUGX
               printf("-com out-");
            #endif
            break;       //  break
         }
         diagnostic_mode = 1;

      }
      i = 0;
      if( diagnostic_mode == 1)  // diagnostic mode
      {
         for( i = 0; i < 20; i++)  // indication for entering diagnostic mode.
         {
            RED_LED_BLINK;
            delay_ms1( 50);
         }
```

FIG. 21K

```
        while( !IS_SWITCH_HIGH);
        while( 1)
        {

          if( IS_PIR2_LED_HIGH)
          {
            DIM_RED_LED_HIGH1; // for red LEDs on main and LED PCB to
become //high
          }
          else
          {
            DIM_RED_LED_LOW1; // for red LEDs on main and LED PCB to
become //low
          }
          if( IS_PIR1_LED_HIGH)
          {
            DIM_YELLOW_LED_HIGH1; // for Yellow LEDs on main and
LED PCB to become //high
          }
          else
          {
            DIM_YELLOW_LED_LOW1;// for yellow LEDs on main and LED
PCB to become //low
          }
          if( !IS_SWITCH_HIGH)// is s1 switch is press n held for 2 s at Power
on
          {
            delay_ms1( 10);
            if( !IS_SWITCH_HIGH)  // if the switch is released within 2 s
            {
              YELLOW_LED_LOW;// make yellow led low
              RECEDING_EVENT_TIME += 1;// increase the receding event
time by 100 ms
```

FIG. 21L

```
        if( RECEDING_EVENT_TIME > MAX_RECEDING_EVENT_TIME)
                {
                  RECEDING_EVENT_TIME =
MIN_RECEDING_EVENT_TIME;
                }
                while( !IS_SWITCH_HIGH);// wait until switch is released

                delay_ms1( 500);// delay
                for( i = 0; i < ( RECEDING_EVENT_TIME * 2); i++)
                {
                  YELLOW_LED_BLINK;// blink yellow led
                  delay_ms1( 300);
                }
              }
            }
          }
        }
      }
  }
  peripherials_init();  // INITIALIZE THE PERIPHERALS
  //_RED_LED_HIGH;// red led high
  #asm("sei");
  while( 1)
  {

    // IF THERE IS EVENT OR NO MOTION IS SENSED
    if( transition_event != 1 && receding_event != 1  &&  MOTION_Z1 == 0)
    {
      DIM_YELLOW_LED_LOW;  // MAKE YELLOW LED LOW
      DIM_RED_LED_LOW;     // MAKE RED LED LOW
      BUZZER_LOW;

    }
    // IF IT IS TRANSITION EVENT
    if( transition_event == 1)
    {

      DIM_YELLOW_LED_HIGH;  // MAKE YELLOW LED HIGH
      //BUZZER_HIGH;        // // MAKE BUZZER HIGH IF IT IS NOT
DISABLED( SEE MACRO)
    }
```

FIG. 21M

```
      //IF IT IS RECEDING EVENT
      else if( receding_event == 1)
      {
         DIM_YELLOW_LED_HIGH; // MAKE YELLOW LED HIGH
         DIM_RED_LED_HIGH;    // MAKE RED LED HIGH
         BUZZER_LOW;
      }
      // IF THERE IS A Z1 EVENT BUT IT IS NOT IN TRANSITION OR
RECEDING MODE
      if( z1_event == 1 && receding_event != 1 && transition_event != 1 &&
MOTION_Z1 != 2)
      {
         DIM_YELLOW_LED_HIGH; // MAKE YELLOW LED HIGH
         TCNT1H=0xf9;
         TCNT1L=0xe5;// 0xf9e5--->0xffff == 100ms  ( TIMER 1)
         MOTION_Z1 = 1;    // START THE WAIT FOR MOTION DETECTION
         no_motion_count = 0; // INTIALIZE THE COUNT TO 0
         // decide_event_count = 0;
         z1_event = 0;
         transition_event = 0;
         receding_event  = 0;
         decide_event = 1;// START THE WAIT TO DECIDE THE MODE
         #ifdef DEBUGX
            printf("-mz1-");
         #endif
      }
   }
}
/*****************************************************************
* Function name:void delay_ms1( unsigned int delay)              *
* Input parameters: delay needed                                 *
* Output parameters: NONE                                        *
* Purpose:delay in milliseconds                                  *
* Processing: See function                                       *
* Returns: NONE                                                  *
*****************************************************************/
void delay_ms1( unsigned int delay)
{
   unsigned int a, b;
   for( a = 0;  a < 98; a++)
      for( b = 0; b < delay; b++);
}
```

FIG. 21N

```
/*****************************************************************
* Function name:void port_init( void)                            *
* Input parameters: NONE                                         *
* Output parameters: NONE                                        *
* Purpose: INITIALIZATION of DATA DIRECTION of PORT PIN          *
* Returns: NONE                                                  *
*****************************************************************/

void port_init( void)
{
   PIR1_LED_DDR;
   PIR1_OP_DDR;
   PIR2_LED_DDR;
   PIR2_OP_DDR;
   RED_LED_DDR;
   YELLOW_LED_DDR;
   DIM_YELLOW_LED_DDR;
   DIM_RED_LED_DDR;
   BUZZER_DDR;
   SWITCH_DDR;
}
/*****************************************************************
* Function name:void interrupt_init( void)                       *
* Input parameters: NONE                                         *
* Output parameters: NONE                                        *
* Purpose: INTERRUPT INITIALIZATION FOR TIMERS AND PIN CHANGE
* Returns: NONE                                                  *
*****************************************************************/
void interrupt_init( void)

   // External Interrupt(s) initialization
   // INT0: On
   // INT0 Mode: Any change
   // INT1: On
   // INT1 Mode: Any change
   // Interrupt on any change on pins PCINT0-7: On
   // Interrupt on any change on pins PCINT8-14: On
   // Interrupt on any change on pins PCINT16-23: On
   EICRA=0x05;
   EIMSK=0x03;
   EIFR=0x03;
   PCICR=0x07;
   PCMSK0=0x01;
   PCMSK1=0x02;
   PCMSK2=0x80;
   PCIFR=0x07;
}
```

FIG. 21O

```
/*************************************************************
* Function name:void timer1_init( void)                      *
* Input parameters: NONE                                     *
* Output parameters: NONE                                    *
* Purpose:TIMER 1 INITIALIZATION                             *
* Processing: See function                                   *
* Returns: NONE                                              *
*************************************************************
void timer1_init( void)
{
   // Timer/Counter 1 initialization
   // Clock source: System Clock
   // Clock value: 125 kHz
   // Mode: Normal top=FFFFh
   // OC1A output: Discon.
   // OC1B output: Discon.
   // Noise Canceler: Off
   // Input Capture on Falling Edge
   // Timer 1 Overflow Interrupt: On
   // Input Capture Interrupt: Off
   // Compare A Match Interrupt: Off
   // Compare B Match Interrupt: Off
   TCCR1A=0x00;
   TCCR1B=0x02;
   TCNT1H=0xff;
   TCNT1L=0xe8;// 0xffe8--->0xffff == 183us
   ICR1H=0x00;
   ICR1L=0x00;
   OCR1AH=0x00;
   OCR1AL=0x00;
   OCR1BH=0x00;
   OCR1BL=0x00;
   TIMSK1=0x01;
}
```

FIG. 21P

```
/*************************************************************
* Function name:void peripherials_init( void)                *
* Input parameters: NONE                                     *
* Output parameters: NONE                                    *
* Purpose: PERIPHERALS INITIALIZATION                        *
* Processing: See function                                   *
* Returns: NONE                                              *
*************************************************************/

void peripherials_init( void)
{

   interrupt_init();  // INTERRUPT INITIALIZATION
   timer1_init();     // TIMER1 INITIALIZATION
   #ifdef DEBUGX     // USART INITIALIZATION
      // USART initialization
      // Communication Parameters: 8 Data, 1 Stop, No Parity
      // USART Receiver: Off
      // USART Transmitter: On
      // USART0 Mode: Asynchronous
      // USART Baud Rate: 4800
      UCSR0A=0x00;
      UCSR0B=0x18;
      UCSR0C=0x06;
      UBRR0H=0x00;
      UBRR0L=0x0C;
   #endif

}
```

FIG. 21Q

COLLISION ALERT SYSTEM

CROSS REFERENCE TO RELATED APPLICATIONS

This application claims the benefit of provisional patent application No. 61/260,404 titled "Collision Alert System", filed on Nov. 12, 2009 in the United States Patent and Trademark Office.

The specification of the above referenced patent application is incorporated herein by reference in its entirety.

BACKGROUND

A person moving in a direction towards a swing side of a swinging barrier, for example, a door may not be aware of the presence of a person approaching the door on the opposite side of the door. In such a scenario, there may be a possibility that when the door opens on the swing side, the door may collide with the person moving towards the swing side of the door, thereby potentially resulting in an injury. Conventional alert systems may be able to detect the presence of a person or an object, or motion of a person or an object on the opposite side of the door and alert the person on the swing side of the door. However, these alert systems may trigger an alarm even if a person on the opposite side of the door is receding away from the door, which may preclude a collision. These conventional alert systems lack the ability to clearly distinguish the nature of motion of a person or an object with respect to the door and provide selective alerts accordingly.

Hence, there is a long felt but unresolved need for a method and system that differentiates between the presence of stationary objects, approaching objects, and receding objects with respect to the swinging barrier, and generates selective alerts for indicating a possible collision between the swinging barrier and the objects on the swing side of the swinging barrier, based on the type of motion of the objects on the opposite side of the swinging barrier.

SUMMARY OF THE INVENTION

This summary is provided to introduce a selection of concepts in a simplified form that are further described in the detailed description of the invention. This summary is not intended to identify key or essential inventive concepts of the claimed subject matter, nor is it intended for determining the scope of the claimed subject matter.

The method and system disclosed herein addresses the above stated need for generating an alert for a possible collision between objects and a swinging barrier. The method and system disclosed herein determines the presence of stationary objects as well as approaching objects and receding objects on both sides of the swinging barrier, for example, a door, and generates selective alerts accordingly. As used herein, the term "objects" refers to animate entities, for example, human beings, or inanimate fixtures, for example, forklifts. The method and system disclosed herein generates selective alerts for indicating a possible collision between the swinging barrier and the objects on the swing side of the swinging barrier, based on the type of motion of the objects on the opposite side of the swinging barrier.

In the method disclosed herein, multiple sensing devices, a control unit, and multiple indicator devices are provided. The sensing devices, the control unit, and the indicator devices are strategically positioned at predetermined areas, for example, an entry area and an exit area, proximal to the swinging barrier. The sensing devices and the control unit electronically communicate with the indicator devices. The control unit electronically communicates with the sensing devices and the indicator devices, for example, via a wired mode of communication, a wireless mode of communication, or any combination thereof.

The sensing devices are configured to establish one or more sensing zones proximal to the swinging barrier. The sensing devices establish the sensing zones by scanning a predetermined area corresponding to a swingable distance of the swinging barrier. The sensing devices can be configured by adjusting the range of sensitivity of the sensing devices. The sensing devices detect the presence of one or more of stationary objects, approaching objects, and receding objects in the established sensing zones proximal to the swinging barrier. The sensing devices detect the presence of the stationary objects by detecting immobility of the stationary objects within and between the established sensing zones. Furthermore, the sensing devices detect movements of the objects in a predefined order for enabling the control unit to determine whether the movements are approaching movements or receding movements based on the predefined order of the detection. The sensing devices can be further configured by adjusting delay time for detecting the approaching movements of the approaching objects and the receding movements of the receding objects between the established sensing zones.

The control unit, in electronic communication with the sensing devices, tracks and differentiates the presence of the stationary objects, approaching movements of the approaching objects, and receding movements of the receding objects in the established sensing zones proximal to the swinging barrier. The control unit generates and triggers an alert signal on detection of one or more of the presence of the stationary objects, the approaching movements of the approaching objects, and the receding movements of the receding objects in established sensing zones proximal to the swinging barrier. The control unit transmits the alert signal to the indicator devices.

The indicator devices selectively indicate a possible collision between the objects and the swinging barrier based on the presence of the stationary objects, the approaching movements of the approaching objects, and the receding movements of the receding objects in the established sensing zones, on receiving the alert signal from the control unit. The indicator devices comprise, for example, visual display devices such as light emitting diodes (LEDs), audio devices such as buzzers, etc. The indicator devices indicate a possible collision between the objects and the swinging barrier for a predetermined period of time based on the approaching movements of the approaching objects and the receding movements of the receding objects in the established sensing zones.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and components disclosed herein.

FIGS. 21A-21Q exemplarily illustrate a C programming language implementation of the method for generating an alert for a possible collision between objects and a swinging barrier.

DETAILED DESCRIPTION OF THE INVENTION

Figure 1:
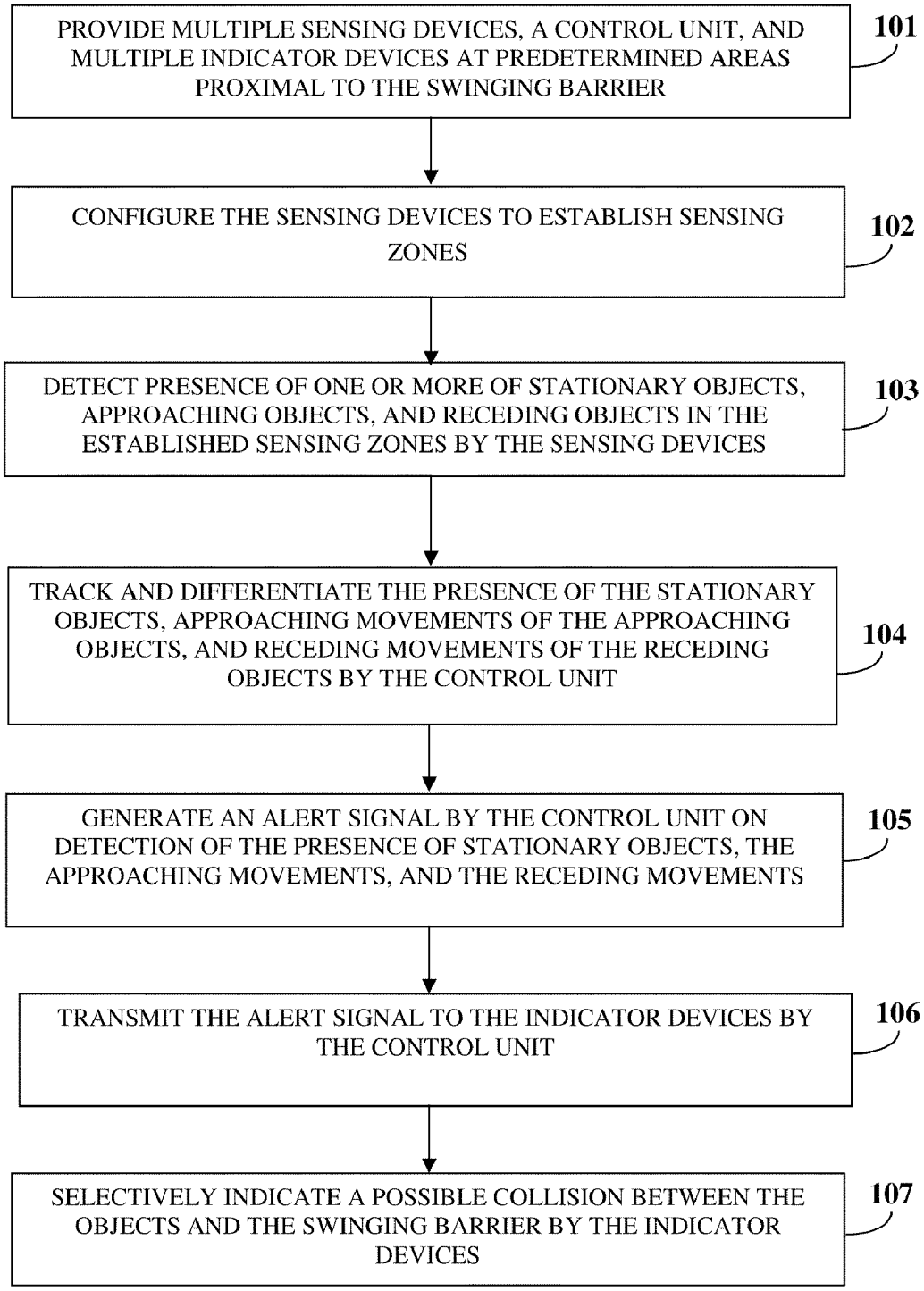
FIG. 1 illustrates a method for generating an alert for a possible collision between objects and a swinging barrier.
Figure 2:
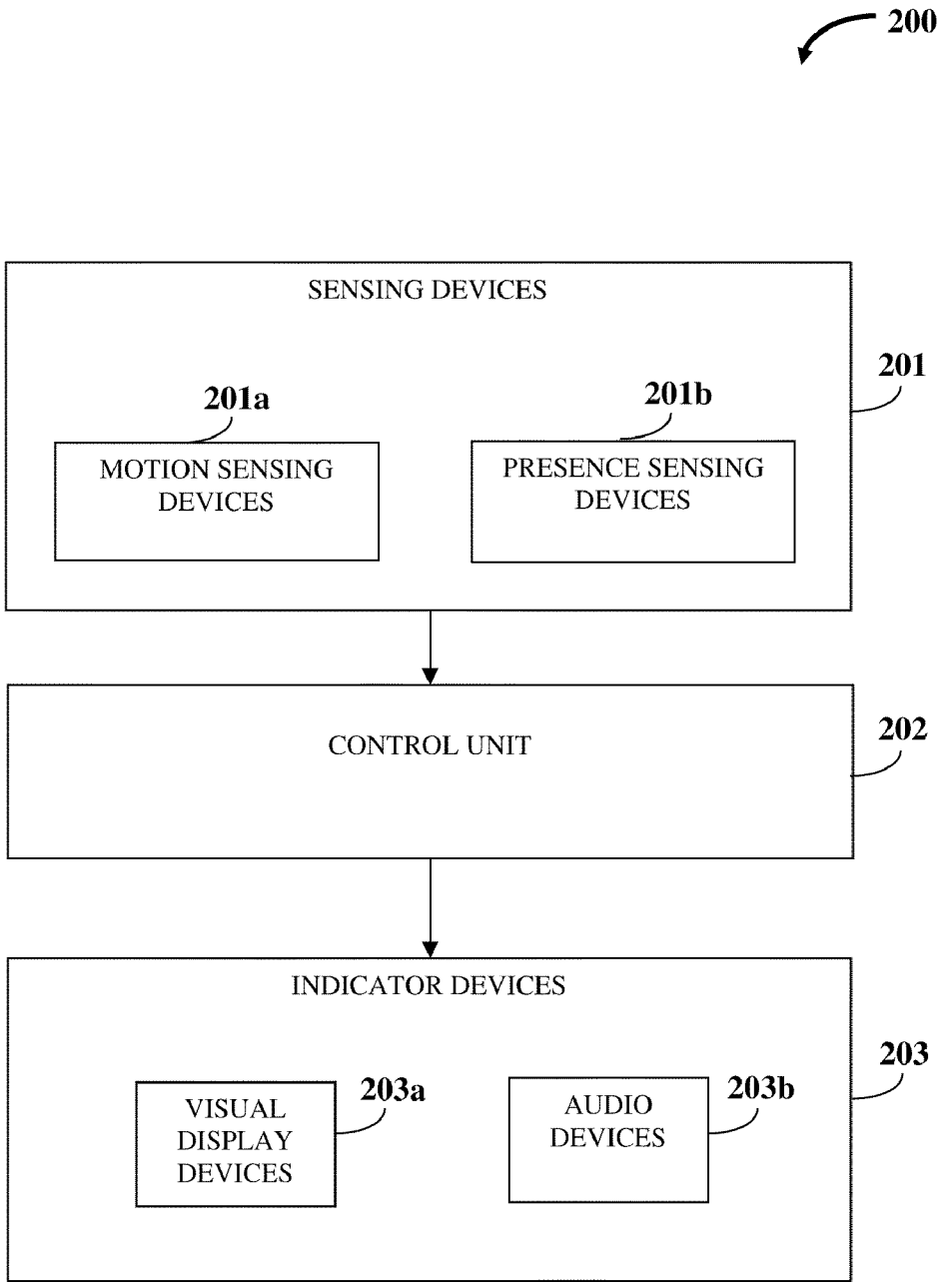
FIG. 2 illustrates a system for generating an alert for a possible collision between objects and a swinging barrier.
Figure 4:
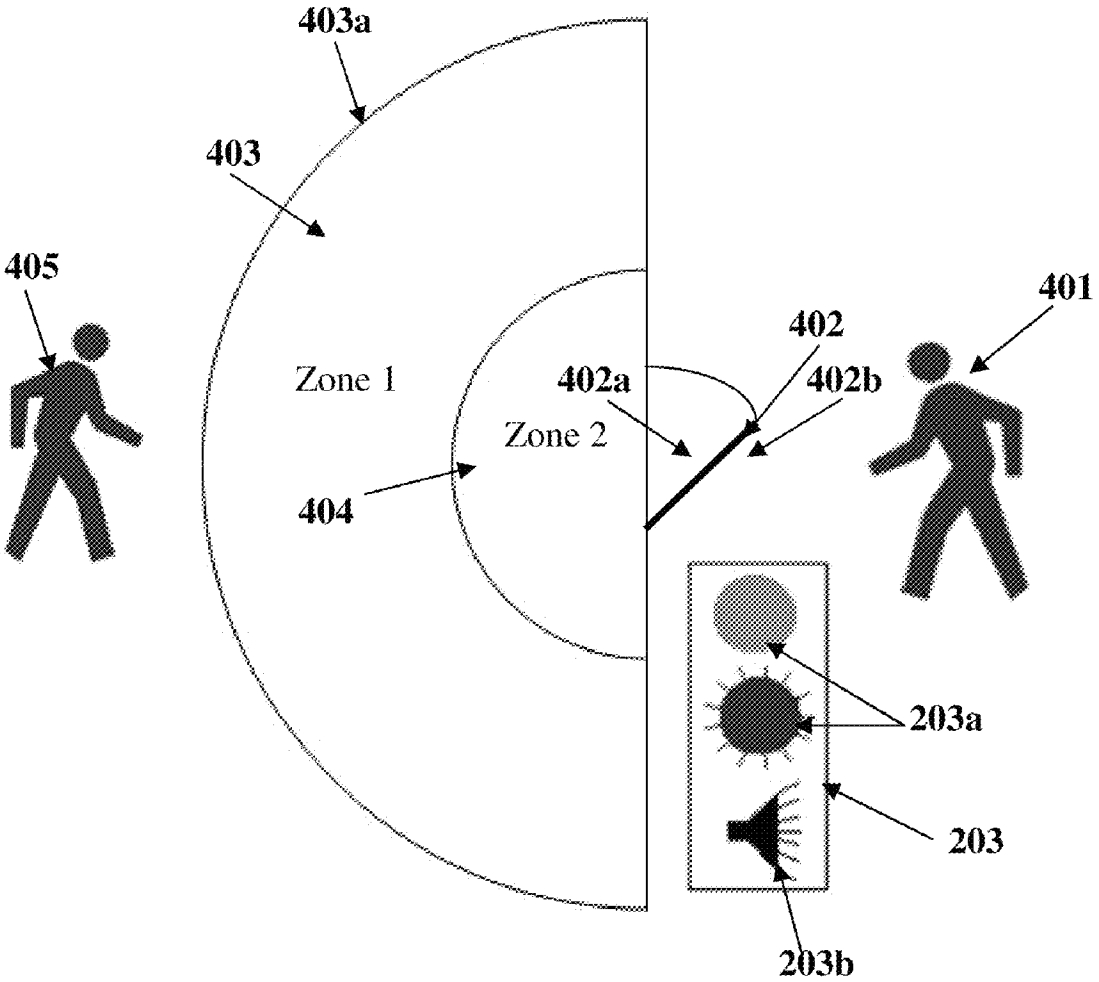
FIG. 4 exemplarily illustrates establishment of dual sensing zones by sensing devices on one side of a swinging barrier.

FIG. 1 illustrates a method for generating an alert for a possible collision between objects 401 and a swinging barrier 402 exemplarily illustrated in FIG. 4. As used herein, the term "swinging barrier" refers to a moveable barrier, for example, a door, having an entry area and an exit area. In the method disclosed herein, multiple sensing devices 201, a control unit 202, and multiple indicator devices 203 as exemplarily illustrated in FIG. 2, are provided 101. The sensing devices 201, the control unit 202, and the indicator devices 203 are strategically positioned at predetermined areas, for example, at the entry area and the exit area proximal to the swinging barrier 402. In an embodiment, the indicator devices 203 and the sensing devices 201 are provided on both sides 402*a* and 402*b* of the swinging barrier 402 to generate an alert on detection of the presence of stationary objects 405, approaching objects 405, and receding objects 405 on both sides 402*a* and 402*b* of the swinging barrier 402. As used herein, the term "objects" refers to persons, goods, cranes, forklifts, other vehicles, obstacles, moving equipment, etc., on either side 402*a* or 402*b* of the swinging barrier 402. As used herein, the term "approaching objects" refers to objects 405 that move towards the swinging barrier 402. Also, as used herein, the term "receding objects" refers to objects 405 that move away from the swinging barrier 402.

The sensing devices 201 comprise one or more motion sensing devices 201*a* and presence sensing devices 201*b*, for example, passive infrared (PIR) sensors, alarm sensors, triangulation sensors, occupancy sensors, etc. The sensing devices 201 and the control unit 202 electronically communicate with the indicator devices 203. The sensing devices 201 are configured 102 to establish one or more sensing zones 403 and 404 proximal to the swinging barrier 402. For example, the sensing devices 201 are configured by adjusting the range of sensitivity of the sensing devices 201. The sensing devices 201 are mounted proximal to the swinging barrier 402 such that the area of sensitivity is along an X-axis 602 of each of the sensing devices 201 as exemplarily illustrated in FIG. 6A. The sensing devices 201 are further configured by adjusting a delay time to, for example, about 500 milliseconds, for detecting the approaching movements and the receding movements of an object 405 between the established sensing zones 403 and 404, with respect to the swinging barrier 402. The sensing devices 201 establish the sensing zones 403 and 404 by scanning a predetermined area corresponding to a swingable distance of the swinging barrier 402. The sensing devices 201 establish the initial sensing zones 403 and 404 based on predetermined angles configured in the sensing devices 201. The sizes of the initial sensing zones 403 and 404 are then fine tuned by adjusting the sensitivity of the sensing devices 201.

The sensing devices 201 detect 103 the presence of one or more stationary objects 405, approaching objects 405, and receding objects 405 in the established sensing zones 403 and 404 proximal to the swinging barrier 402. The sensing devices 201 detect the presence of the stationary objects 405 by detecting immobility of the stationary objects 405 within and between the established sensing zones 403 and 404. The sensing devices 201 detect movements of the objects 405 in a predefined order for enabling the control unit 202 to determine whether the movements are approaching movements or receding movements with respect to the swinging barrier 402 based on the predefined order detection.

Consider an example where a sensing device 201 on one side 402*a* of the swinging barrier 402 establishes sensing zones, for example, zone 1 403 and zone 2 404 as exemplarily illustrated in FIG. 4. The control unit 202 determines that an object 405 is an approaching object with respect to the swinging barrier 402 when the sensing device 201 detects movement of the object 405 from zone 1 403 to zone 2 404 within a predetermined period of time set during the configuration of the sensing device 201. The control unit 202 determines that an object 405 is a receding object when the sensing device 201 detects movement of the object 405 from zone Z2 404 to zone Z1 403 within a predetermined period of time, that is, the delay time, set during configuration of the sensing device 201. The predetermined period of time is, for example, based on the environment in which the sensing devices 201, the control unit 202, and the indicator devices 203 defining a collision alert system 200 is located.

The control unit 202, in electronic communication with the sensing devices 201, tracks and differentiates 104 the presence of the stationary objects 405, approaching movements of the approaching objects 405, and receding movements of the receding objects 405 in the established sensing zones 403 and 404 proximal to the swinging barrier 402. The control unit 202 generates 105 and triggers an alert signal on detection of one or more of the presence of the stationary objects 405, the approaching movements of the approaching objects 405, and the receding movements of the receding objects 405 in the established sensing zones 403 and 404 proximal to the swinging barrier 402. The control unit 202 transmits 106 the alert signal to the indicator devices 203.

The indicator devices 203 selectively indicate 107 a possible collision between the objects 401 and the swinging barrier 402 based on the presence of the stationary objects 405, the approaching movements of the approaching objects 405, and the receding movements of the receding objects 405 in the established sensing zones 403 and 404, on receiving the alert signal from the control unit 202. The indicator devices 203 comprise, for example, visual display devices 203*a* such as light emitting diodes (LEDs) and audio devices 203*b* such as buzzers for selectively indicating a possible collision between the objects 401 and the swinging barrier 402. The indicator devices 203 indicate a possible collision between the objects 401 and the swinging barrier 402 for a predetermined period of time based on the approaching movements of the approaching objects 405 and the receding movements of the receding objects 405 in the established sensing zones 403 and 404. For example, the indicator devices 203 selectively indicate the potential for collision as follows: The control unit 202 triggers an alert signal to invoke a yellow LED only for a stationary object 405 or a passerby passing by an outer limit 403*a* of zone 1 403, which defines a low potential for collision. The control unit 202 triggers an alert signal to invoke a red LED and a yellow LED on detecting a receding movement of a receding object 405, which defines a medium potential for collision. The control unit 202 triggers an alert signal to invoke a flashing red LED, a yellow LED, and a buzzer on detecting an approaching movement of an approaching object 405, which defines a high potential for collision.

FIG. 2 illustrates a system 200 for generating an alert for a possible collision between objects 401 and a swinging barrier 402. The system 200 for generating an alert for a possible collision between the objects 401 and the swinging barrier 402 is herein referred to as a "collision alert system". The collision alert system 200 disclosed herein comprises multiple sensing devices 201 strategically positioned at predetermined areas, for example, the entry area and the exit area proximal to the swinging barrier 402. The sensing devices 201 are configured to establish sensing zones 403 and 404 proximal to the swinging barrier 402. The sensing devices 201 detect the presence of one or more stationary objects 405, approaching objects 405, and receding objects 405 in the established sensing zones 403 and 404 proximal to the swinging barrier 402 as disclosed in the detailed description of FIG. 1. The sensing devices 201 comprise, for example, one or more motion sensing devices 201*a* and presence sensing devices 201*b*. The presence sensing devices 201*b* detect the presence of the stationary objects 405. The motion sensing devices 201*a* detect objects 405 in motion, namely, the approaching objects 405 and the receding objects 405 in the established sensing zones 403 and 404. The approaching objects 405 are in motion in the direction of the swinging barrier 402, while the receding objects 405 are in motion in a direction opposite to or away from the swinging barrier 402. The motion sensing devices 201*a* are, for example, passive infrared (PR) sensors and are herein referenced by the numeral 201*a*. For purposes of illustration, the detailed description refers to PIR sensors 201*a* for detecting presence or movement of an object 405. However, the scope of the method and the collision alert system 200 disclosed herein is not limited to PIR sensors 201*a* but may be extended to include alarm sensors, triangulation sensors, occupancy sensors, etc., and other functionally equivalent sensing devices.

The PIR sensors 201*a* work on a principle of heat change sensing which is based on emission of black body radiation by the objects 405. The PIR sensors 201*a* detect infrared (IR) radiation, which is invisible to a human eye. The PIR sensors 201*a* do not produce infrared radiation, but passively accept the incoming infrared radiation. The PIR sensors 201*a* measure the infrared radiation emitted by the objects 405 in their field of view. The PIR sensors 201*a* detect motion of the object 405 when the object 405, for example, a human emitting infrared radiation, at a certain temperature passes in front of an infrared source, for example, the swinging barrier 402, at another temperature.

The collision alert system 200 disclosed herein further comprises a control unit 202 in electronic communication with the sensing devices 201 and the indicator devices 203 for processing, controlling, and monitoring the sensing devices 201 and the indicator devices 203. The control unit 202 electronically communicates with the sensing devices 201 and the indicator devices 203, for example, via a wired mode of communication through electrical cables 501 and 303 respectively as exemplarily illustrated in FIG. 5 and FIG. 3, a wireless mode of communication through a Bluetooth™ communication protocol, a WiFi communication protocol, or other wireless communication protocols, and any combination thereof. The control unit 202 tracks and differentiates the presence of the stationary objects 405, approaching movements of the approaching objects 405, and receding movements of the receding objects 405 in the established sensing zones 403 and 404 proximal to the swinging barrier 402. The control unit 202 generates and triggers an alert signal on detection of the presence of the stationary objects 405, the approaching movements of the approaching objects 405, and the receding movements of the receding objects 405 in the established sensing zones 403 and 404 proximal to the swinging barrier 402.

The collision alert system 200 disclosed herein further comprises indicator devices 203 in electronic communication with the control unit 202. The indicator devices 203 comprise one or more visual display devices 203*a*, for example, light emitting diodes (LEDs) that emit light of different colors such as yellow, red, flashing red, etc. The visual display devices 203*a* provide a visual indication for indicating a possible collision between the objects 401 and the swinging barrier 402 on receiving the generated alert signal from the control unit 202. The indicator devices 203 further comprise one or more audio devices 203*b*, for example, alerting beacons, buzzers, beepers, etc. The audio devices 203*b* provide an audio indication for indicating a possible collision between the objects 401 and the swinging barrier 402 on receiving the generated alert signal from the control unit 202. In an embodiment, the sensing devices 201, the indicator devices 203, and the control unit 202 are powered, for example, by different power sources.

The indicator devices 203 selectively indicate a possible collision between the objects 401 and the swinging barrier 402 based on the presence of the stationary objects 405, the approaching movements of the approaching objects 405, and the receding movements of the receding objects 405 in the established sensing zones 403 and 404, on receiving the generated alert signal from the control unit 202. For example, on detection of a stationary object 405 on one side 402*a* of the swinging barrier 402, the control unit 202 generates an alert signal to light up a yellow LED on the other side 402*b*, that is, the swing side 402*b* of the swinging barrier 402 to alert a second object 401 on the swing side 402*b* of the presence of the stationary object 405. The control unit 202 also generates an alert signal to light up a yellow LED on the swing side 402*b* of the swinging barrrier 402 to alert a second object 401, if the first object 405 is passing by the outer limit 403*a* of the established sensing zone 1 403 as exemplarily illustrated in FIG. 4. On detection of an approaching object 405 on one side 402*a* of the swinging barrier 402, the control unit 202 generates an alert signal to activate a flashing red LED, a yellow LED, and a buzzer on the swing side 402*b* of the swinging barrier 402 to alert the second object 401 on the swing side 402*b* of the swinging barrier 402 of a possible collision within the swinging radius. On detection of a receding object 405 on one side 402*a* of the swinging barrier 402, the collision alert system 200 lights up a yellow LED and a red LED to alert the second object 401 on the swing side 402*b* of the swinging barrier 402 of the receding object 405.

Figure 5:
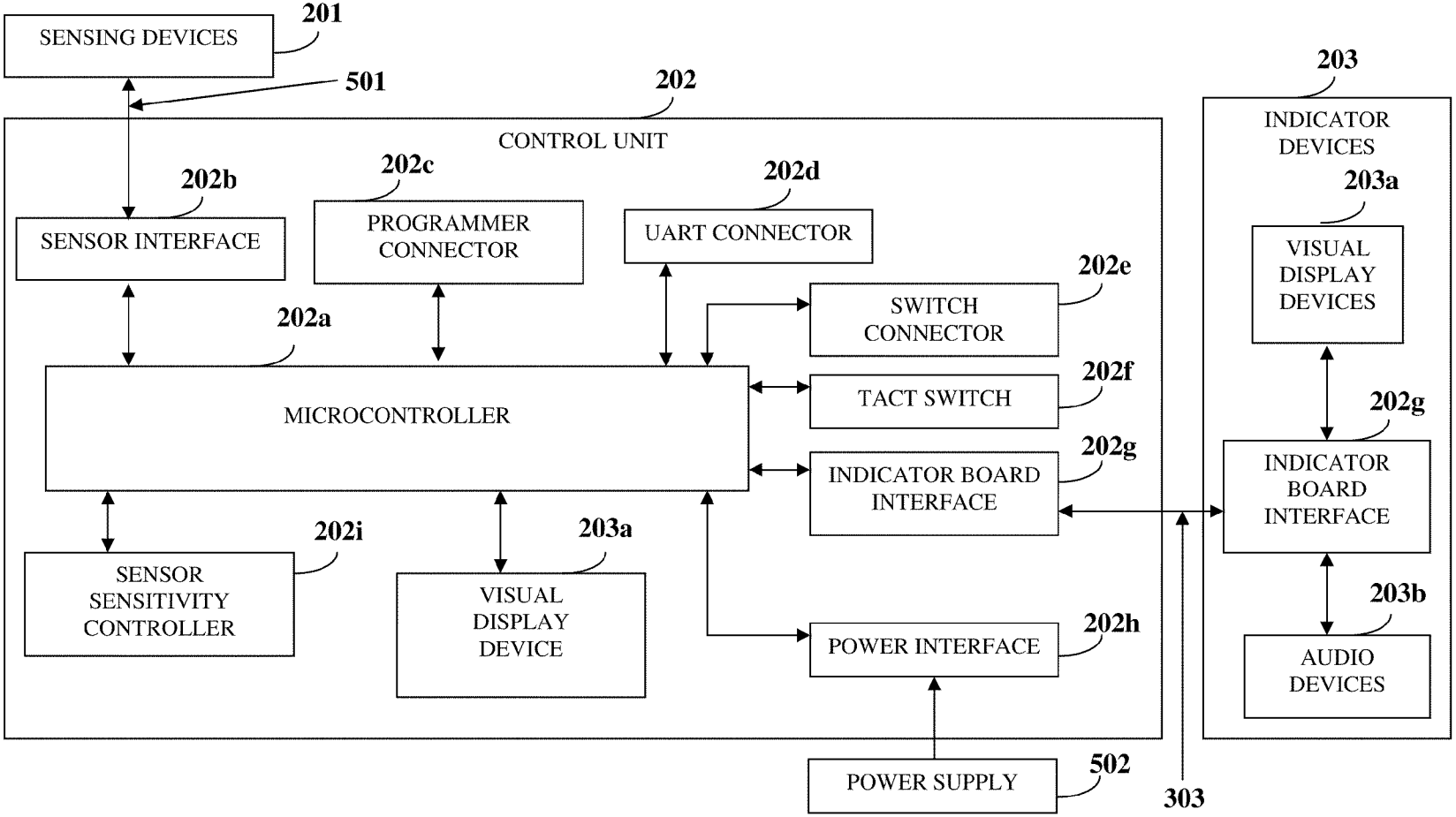
FIG. 5 exemplarily illustrates a block diagram of the collision alert system, showing electronic communication between the sensing devices, a control unit, and indicator devices of the collision alert system.

The collision alert system 200 further comprises a power supply 502, as exemplarily illustrated in FIG. 5, provided in a housing (not shown) proximal to the swinging barrier 402 for powering the sensing devices 201, the control unit 202, and the indicator devices 203. The power supply 502 is, for example, a source of alternating current (AC) or a direct current (DC). In an embodiment, the sensing devices 201, the control unit 202, and the indicator devices 203 can be powered separately.

Figure 3:
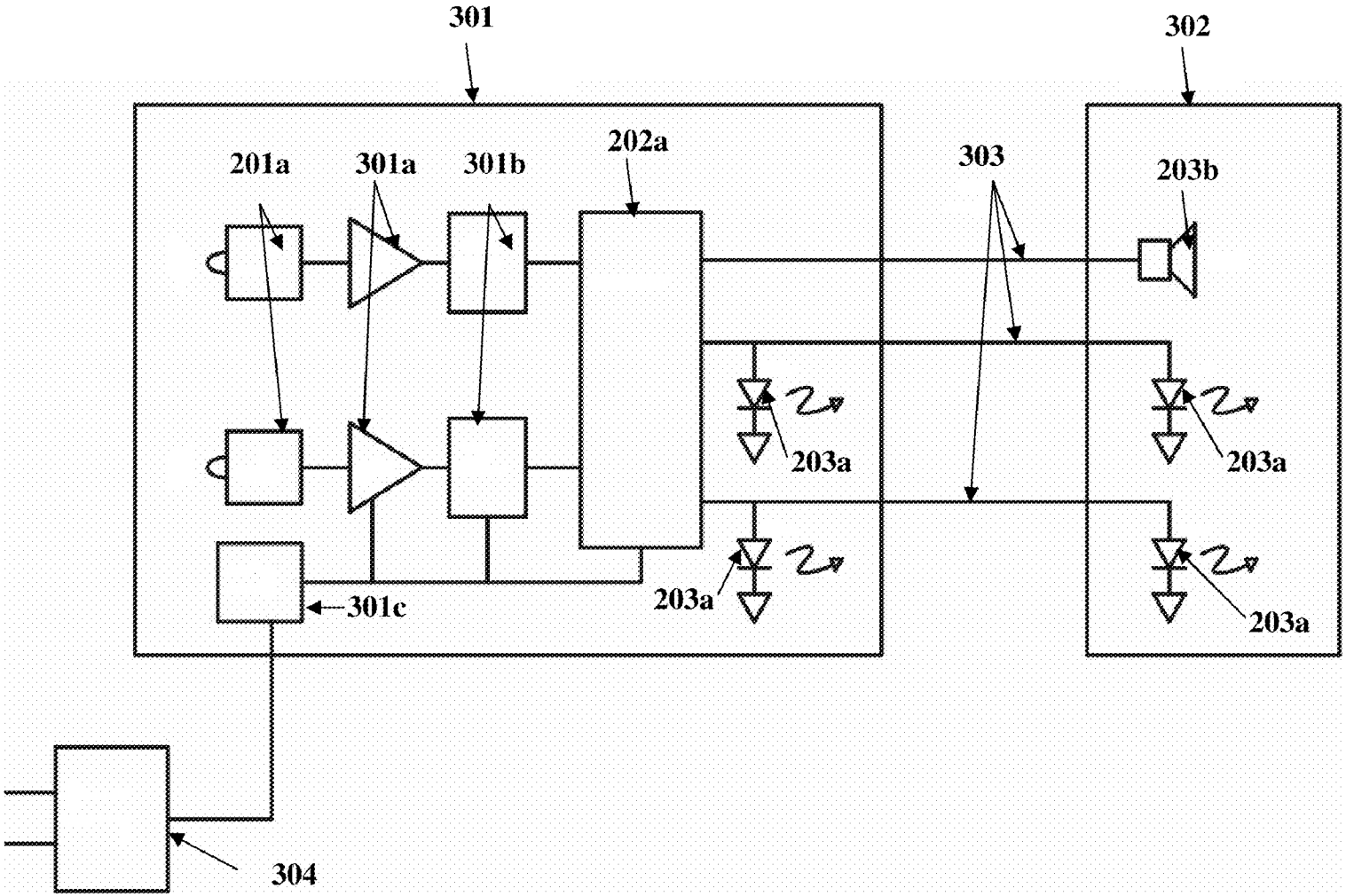
FIG. 3 exemplarily illustrates a collision alert system, showing electronic communication between a front door module and a back door module positioned on opposing sides of a swinging barrier.

FIG. 3 exemplarily illustrates a collision alert system 200, showing electronic communication between a front door module 301 and a back door module 302 positioned on opposing sides 402*a* and 402*b* of a swinging barrier 402. The collision alert system 200 disclosed herein comprises the front door module 301 and the back door module 302 that electronically communicate with each other, for example, via a wired mode of communication, a wireless mode of communication, or any combination thereof. In an embodiment, the front door module 301 comprising the sensing devices 201 and the control unit 202 of the collision alert system 200 is positioned on a side 402*a* opposite to the swing side 402*b* of the swinging barrier 402, and the back door module 302 comprising the indicator devices 203 are positioned on the swing side 402*b* of the swinging barrier 402 as exemplarily illustrated in FIG. 4. The control unit 202 and the indicator devices 203 electronically communicate with each other, for example, via electrical cables 303. In an embodiment, the control unit 202 electronically communicates with the indicator devices 203, for example, via a Bluetooth™ communication protocol, a ZigBee® wireless communication protocol, a WiFi communication protocol, etc. Furthermore, in an embodiment, the control unit 202 electronically communicates the sensing devices 201, for example, via electrical cables 501 or a Bluetooth™ communication protocol, ZigBee® wireless communication protocol, etc.

The front door module 301 comprises a pair of sensing devices 201, for example, passive infrared (PIR) sensors 201*a*, a pair of amplifiers 301*a*, and "signal on delay" units 301*b* connected to a microcontroller 202*a* of the control unit 202. In an embodiment, the "signal on delay" unit 301*b* sets timers for enabling the control unit 202 to distinguish between approaching movements of the approaching objects 405 and receding movements of the receding objects 405. The back door module 302 comprises the indicator devices 203. The microcontroller 202*a* controls a first set of indicator devices 203 in the front door module 301 and a second set of indicator devices 203 in the back door module 302 connected via the electrical cables 303. The first set of indicator devices 203 comprise visual display devices 203*a*, for example, a yellow light emitting diode (LED) and a red light emitting diode (LED). The second set of indicator devices 203 comprise visual display devices 203*a*, for example, a yellow light emitting diodes (LED), a red light emitting diode (LED), etc., and an audio device 203*b*, for example, a buzzer. The visual display devices 203*a* and the audio devices 203*b* are disposed in a housing 702, as exemplarily illustrated in FIG. 7, and positioned on the swing side 402*b* of the swinging barrier 402 to form the back door module 302. A wall mount transformer 304 provides electric power to the front door module 301 via a power regulator 301*c*.

The sensing devices 201 are configured to define and establish sensing zones 403 and 404, for example, in a long area range or a short area range. The sensing devices 201, for example, passive infrared (PIR) sensors 201*a* detect the presence of stationary objects 405, approaching objects 405, and receding objects 405, within the long area range or the short area range. The PIR sensors 201*a* are contained within a housing 701, as exemplarily illustrated in FIG. 7, strategically positioned at the entry area and/or the exit area defined by the swinging barrier 402. The PIR sensors 201*a* along with the control unit 202 of the collision alert system 200 monitor the areas around the swinging barrier 402. The PIR sensors 201*a* measure infrared energy radiated from the objects 405 in their range or field of view. The PIR sensors 201*a* detect infrared energy radiated from stationary objects 405, approaching objects 405, and receding objects 405 in the sensing zones 403 and 404. The PIR sensors 201*a* establish a serial array of sensing zones 403 and 404 proximate to the entry area and the exit area of the swinging barrier 402. The PIR sensors 201*a* also detect motion of an object 405, for example, when a human with one temperature passes in front of the swinging barrier 402 with another temperature. When the PIR sensors 201*a* detect the presence of objects 405, for example, stationary objects 405, and approaching movements of the approaching objects 405 in the sensing zones 403 and 404, the microcontroller 202*a* generates and triggers an alert signal that selectively activates the visual display devices 203*a* and the audio device 203*b* on the back door module 302. The collision alert system 200 sounds the alarm of the audio device 203*b*, thereby alerting an object 401 facing the swing side 402*b* of the swinging barrier 402 of a possible collision.

FIG. 4 exemplarily illustrates establishment of dual sensing zones 403 and 404 by the sensing devices 201 on one side 402*a* of a swinging barrier 402. Consider an example where two sensing devices 201, for example, passive infrared (PIR) sensors 201*a*, are positioned on one side 402*a* of the swinging barrier 402. Each of the PR sensors 201*a* establish a sensing zone, for example, zone 1 403 and zone 2 404 respectively. The control unit 202 is also positioned on the side 402*a* opposing the swing side 402*b* of the swinging barrier 402. The indicator devices 203 comprising the visual display devices 203*a* such as a yellow LED and a red LED and the audio devices 203*b* such as a buzzer are positioned on the swing side 402*b* of the swinging barrier 402. In an embodiment, indicator devices 203, for example, a yellow LED and a red LED are also provided in the control unit 202. The sensing devices 201 and the control unit 202 positioned on one side 402*a* of the swinging barrier 402 electronically communicate with the indicator devices 203 on the swing side 402*b* of the swinging barrier 402.

The indicator devices 203 provided in the control unit 202 are activated as follows: When there is any motion in zone 1

403, the control unit 202 generates and transmits an alert signal to turn on one of the indicator devices 203, for example, a yellow LED of the control unit 202. When there is any motion in zone 2 404, the control unit 202 generates and transmits an alert signal to turn on one of the indicator devices 203, for example, a red LED of the control unit 202. The indicator devices 203 of the control unit 202 communicate with the indicator devices 203 on the swing side 402*b* of the swinging barrier 402.

When one of the PIR sensors 201*a* detects an approaching object 405 facing one side 402*a* of the swinging barrier 402, with approaching movements in the direction of the swinging barrier 402 in zone 1 403, the control unit 202 generates and transmits an alert signal to turn on one of the indicator devices 203, for example, a yellow LED on the swing side 402*b* of the swinging barrier 402. The PIR sensors 201*a* continue to monitor and detect motion of an object 405 between zone 1 403 and zone 2 404. The yellow LED continues to stay on as long as there is motion detected in zone 1 403. If one of the PIR sensors 201*a* does not detect any motion in zone 1 403, the yellow LED stays on for a predetermined period of time, for example, five seconds, before turning off.

If the object 405 moves from zone 1 403 to zone 2 404, the yellow LED on the swing side 402*b* of the swinging barrier 402 continues to stay on. When the other PIR sensor 201*a* detects motion in zone 2 404, the control unit 202 generates and transmits an alert signal to another one of the indicator devices 203, for example, a red LED on the swing side 402*b* of the swinging barrier 402. The red LED starts blinking as long as there is motion detected in zone 2 404. The control unit 202 also generates and transmits an alert signal to activate the audio device 203*b* on the swing side 402*b* of the swinging barrier 402, when there is continued motion detected in zone 2 404. If there is no motion detected in zone 2 404, the control unit 202 waits for about five seconds before turning off the audio device 203*b*. The control unit 202 also turns off the red LED and the yellow LED on the swing side 402*b* of the swinging barrier 402.

If the object 405 moves from zone 2 404 to zone 1 403, both the PIR sensors 201*a* detect the receding movement of the receding object 405 away from the side 402*a* of the swinging barrier 402 with a delay known as a recede delay. If the PIR sensors 201*a* detect motion with a delay exceeding the recede delay, the control unit 202 considers the movement of the object 405 as an approaching movement in a direction towards the swinging barrier 402 and sends an alert signal to the indicator devices 203 accordingly. The recede delay can be reconfigured from, for example, about 500 milliseconds (ms) to about 1500 ms. When motion is detected by both the PIR sensors 201*a* within the recede delay, the control unit 202 activates both the red LED and the yellow LED on the swing side 402*b* of the swinging barrier 402.

If the object 405 in motion does not leave both the zone 1 403 and zone 2 404 within a predetermined period of time, for example, 5 seconds, the control unit 202 considers the movement as an approaching movement and activates the red LED, while the yellow LED continues to remain turned on. If the object 405 in motion has crossed zone 2 404 within a predetermined period of time, for example, 5 seconds, but continues moving in zone 1 403, then the control unit 202 turns the red LED off, while the yellow LED continues to be turned on until one of the PIR sensors 201*a* does not detect any motion in zone 1 403. The control unit 202 turns off the yellow LED after a predetermined period of time, for example, 5 seconds. In an embodiment, the indicator devices 203 can be disabled or turned off through a tact switch 202*f* provided in the control unit 202, or through an external switch (not shown) connected to a switch connector 202*e* on the control unit 202 as exemplarily illustrated in FIG. 5.

FIG. 5 exemplarily illustrates a block diagram of the collision alert system 200, showing electronic communication between the sensing devices 201, the control unit 202, and the indicator devices 203 of the collision alert system 200. The control unit 202 is implemented on a printed circuit board. The control unit 202 comprises a sensor interface 202*b*, a programmer connector 202*c*, a universal asynchronous receiver/transmitter (UART) connector 202*d*, a switch connector 202*e*, a tact switch 202*f*, an indicator board interface 202*g*, a power interface 202*h*, a sensor sensitivity controller 202*i*, and a visual display device 203*a* mechanically supported and electrically connected on the printed circuit board of the control unit 202. The control unit 202 electronically communicates with the sensing devices 201 via the sensor interface 202*b*. The sensing devices 201 are also implemented on individual or combined printed circuit boards. The programmer connector 202*c* provides an interface for controlling programmable aspects of the microcontroller 202*a*. The microcontroller 202*a* is programmed using program codes written, for example, in a C computer programming language as exemplarily illustrated in FIGS. 21A-21Q.

The universal asynchronous receiver/transmitter (UART) connector 202*d* connects to a UART, which is a programmed microchip that controls interfacing of the control unit 202 with the sensing devices 201 and the indicator devices 203. The UART exchanges data between the sensing devices 201 and the indicator devices 203. The data exchange between the sensing devices 201 and the control unit 202 occurs via the sensor interface 202*b*. The data exchange between the indicator devices 203 and the control unit 202 occurs via the indicator board interface 202*g*. The switch connector 202*e* enables connection of the control unit 202 to an external switch used for enabling or disabling the indicator devices 203, for example, the visual display device 203*a* on the printed circuit board. The tact switch 202*f* can be used to configure the collision alert system 200 in a diagnostic mode of operation. The tact switch 202*f* is also used to disable the indicator devices 203. The indicator devices 203 are also implemented on individual or combined printed circuit boards.

The control unit 202 electronically communicates with the indicator devices 203, for example, the visual display devices 203*a* and the audio devices 203*b* via the indicator board interface 202*g* of each of the control unit 202 and the indicator devices 203. The control unit 202 is powered up through the power interface 202*h* using, for example, a 9 volts, 600 milliamperes (mA) alternating current (AC)/direct current (DC) adapter. The sensing devices 201 are powered, for example, using the 9 Volts, 600 mA alternating current (AC)/direct current (DC) adapter through the power interface 202*h*, or through the sensor interface 202*b* depending on whether the sensing devices 201 are connected via a wired connection using the electrical cables 501 or a wireless connection. The indicator devices 203 are powered, for example, using the 9 Volts, 600 mA alternating current (AC)/direct current (DC) adapter through the power interface 202*h*, or through the indicator board interface 202*g* depending on whether the indicator devices 203 are connected via a wired connection or a wireless connection. The indicator devices 203 are connected to the control unit 202, for example, through the electrical cables 303 via the indicator board interfaces 202*g*.

In this embodiment, the sensing devices 201, for example, a pair of PIR sensors 201*a* is connected to the control unit 202 via the sensor interface 202*b*, for example, using the electrical cables 501. The sensor sensitivity controller 202*i* is used for configuring or calibrating the PIR sensors 201*a* for adjusting their sensitivity of sensing or motion detection. For example, the sensor sensitivity controller 202*i* calibrates one PIR sensor 201*a* to detect motion in zone 1 403 and another PIR sensor 201*a* to detect motion in zone 2 404 as exemplarily illustrated in FIG. 4.

Figure 6A:
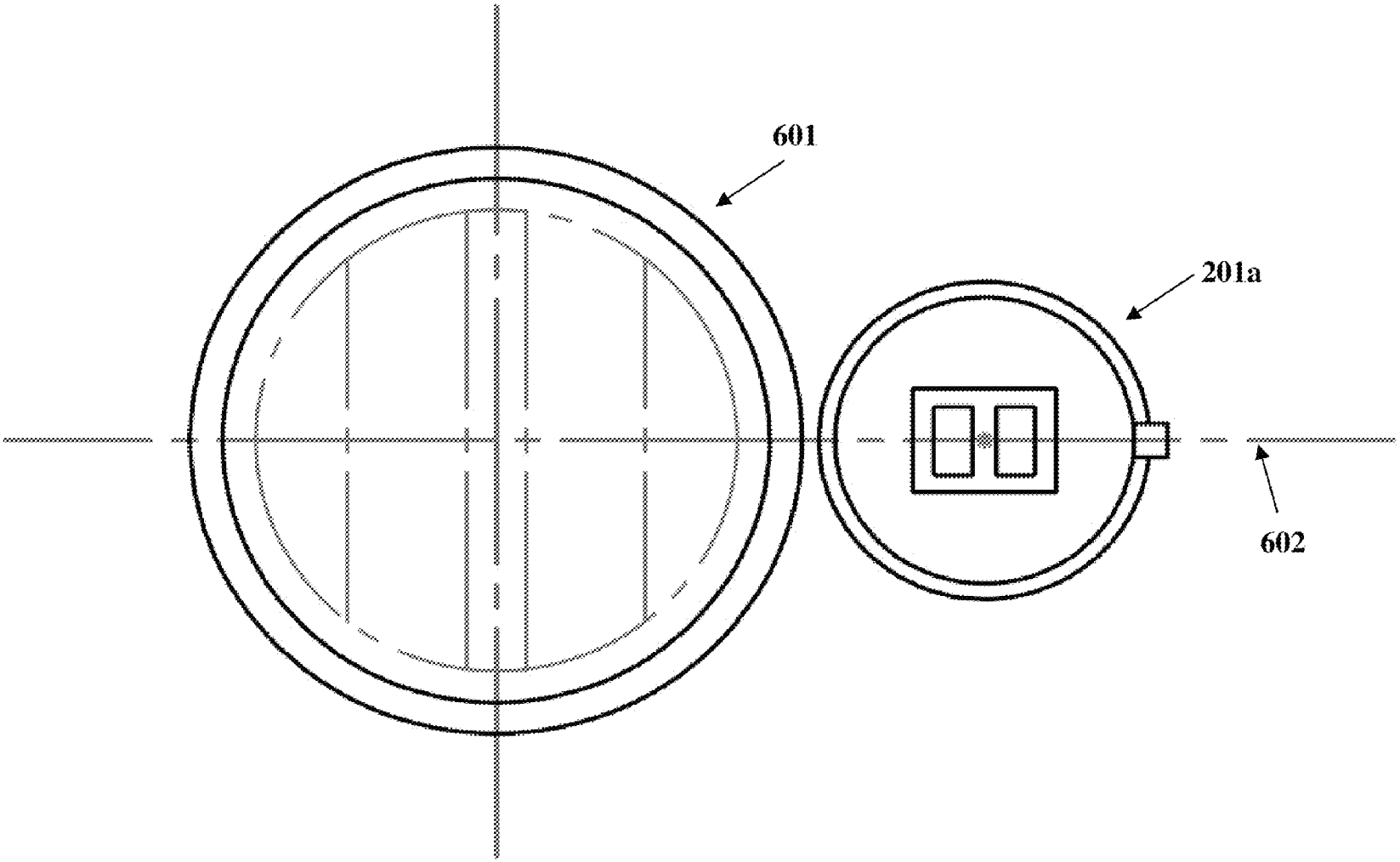
FIG. 6A exemplarily illustrates positioning of a Fresnel lens on a sensing device along an X-axis of the sensing device in the collision alert system.

In the diagnostic mode of operation, the configuration and calibration of each of the PIR sensors 201*a* comprises positioning the PIR sensors 201*a* such that the area where the motion is detected by the PIR sensors 201*a* comes along an X-axis 602 of each of the PIR sensors 201*a* as exemplarily illustrated in FIG. 6A, adjusting the sensitivity of the PIR sensors 201*a*, and adjusting the recede delay. Consider an example of adjusting the sensitivity of the PIR sensors 201*a*. A user turns off the power supply 502 to the control unit 202 via the power interface 202*h*. The user presses and holds down the tact switch 202*f* on the control unit 202 and then turns on the power supply 502 to the control unit 202 via the power interface 202*h*. After the control unit 202 is powered by the power supply 502, the user presses and holds down the tact switch 202*f* for a predetermined period of time, for example, about two seconds to about three seconds, until a visual display device 203*a*, for example, a red LED starts to blink and continues to blink, for example, about ten times. The blinking of the red LED indicates entry of the control unit 202 in the diagnostic mode. If the red LED does not blink about ten times in three seconds, the control unit 202 is in the normal mode of operation and needs to enter the diagnostic mode of operation.

Other visual display devices 203*a*, for example, yellow LEDs are provided on the control unit 202 in the front door module 301 and on the printed circuit board housing the indicator devices 203 in the back door module 302. The yellow LED on the control unit 202 and the yellow LED of the indicator device board blink when there is motion detected by one of the PIR sensors 201*a* in zone 1 403. The user can vary the sensitivity by adjusting the sensor sensitivity controller 202*i* which comprises, for example, a variable resistor. The user can increase the sensitivity of the PIR sensor 201*a* by rotating a knob of the sensor sensitivity controller 202*i*, for example, in an anti-clockwise direction. The user can decrease the sensitivity of the PIR sensor 201*a* by rotating the knob of the sensor sensitivity controller 202*i*, for example, in a clockwise direction. The red LEDs on the control unit 202 and the indicator device board blink when there is motion detected in zone 2 404 by the other PIR sensor 201*a*. The user can vary the sensitivity of the other PIR sensor 201*a* by adjusting the sensor sensitivity controller 202*i*. The user can increase the sensitivity of the other PIR sensor 201*a* by rotating the knob of the sensor sensitivity controller 202*i*, for example, in an anti-clockwise direction. The user can decrease the sensitivity of the other PIR sensor 201*a* by rotating the knob of the sensor sensitivity controller 202*i*, for example, in a clockwise direction. To enter the normal mode from the diagnostic mode, the user can turn off the power supply 502 which powers the control unit 202 and the PIR sensors 201*a* and then turn the power supply 502 back on to enter the normal mode of operation.

Consider an example for adjusting the recede delay. The recede delay is defined as the time elapsed between motion detected in zone 1 403 and zone 2 404, which aids the control unit 202 in distinguishing between an approaching movement and a receding movement. A typical value for the recede delay is, for example, 500 milliseconds, which can be adjusted by the user in the diagnostic mode of operation. To adjust the recede delay, the user first turns off the power supply 502 to the control unit 202 via the power interface 202*h* and disconnects each of the PIR sensors 201*a* connected to the control unit 202 via the sensor interface 202*b*. The user presses and holds down the tact switch 202*f* on the control unit 202 and then turns on the power supply 502 to the control unit 202 via the power interface 202*h*. After the control unit 202 is powered by the power supply 502, the user presses and holds down the tact switch 202*f* for a predetermined period of time, for example, about two seconds to about three seconds, until a visual display device 203*a*, for example, a red LED starts to blink and continues to blink, for example, about ten times.

When the tact switch 202*f* on the control unit 202 or the external switch connected to the switch connector 202*e* is pressed, the recede delay is increased, for example, by 100 milliseconds (ms). The user can vary the recede delay from 500 ms to 1500 ms. The yellow LED on the control unit 202 blinks a few times to indicate the recede delay. The number of blinks multiplied by 100 ms indicates the recede delay. The user can further increase the recede delay by repeatedly pressing the tact switch 202*f* or the external switch. When the recede delay reaches 1500 ms and the user presses the tact switch 202*f* or the external switch again, the recede delay is reset to the initial value of 500 ms. To exit from the diagnostic mode of operation after adjusting the recede delay, the user turns off the power supply 502, reconnects the PIR sensors 201*a*, and turns on the power supply 502 to enter the normal mode of operation.

FIG. 6A exemplarily illustrates positioning of a Fresnel lens 601 on a sensing device 201 along an X-axis 602 of the sensing device 201 in the collision alert system 200. The sensing device 201, for example, the PIR sensor 201*a* is mounted proximal to the swinging barrier 402 so that the area where the motion is to be detected comes along an X-axis 602 of the PIR sensor 201*a*. In an embodiment, a Fresnel lens 601 is mounted on the PIR sensor 201*a* so that the X-axis 602 of the Fresnel lens 601 is parallel to the X-axis 602 of the PIR sensor 201*a*. The Fresnel lens 601 is made of a high density polyethylene material. The Fresnel lens 601 filters infrared radiation to the PIR sensor 201*a* by focusing infrared radiation into the center of the PIR sensor 201*a* by usage of concentric circles. This allows for the widest range x, y, and z axes of detection, and therefore establishment of different wider sensing zones 403 and 404.

The Fresnel lens 601 is mounted on the PIR sensor 201*a* so that the X-axis 602 of the Fresnel lens 601 is parallel to the X-axis 602 of the PIR sensor 201*a* to enable adjustment of the sizes of the sensing zones 403 and 404 established by the PIR sensor 201*a*. The sizes of the initial sensing zones 403 and 404 are fine tuned by adjusting the sensitivity of the sensing devices 201 using the sensor sensitivity controller 202*i*. The Fresnel lens 601 has sensing patterns that are aligned with respect to the sensing zones 403 and 404 established by the sensing devices 201. Sensing areas of the Fresnel lens 601 are adjusted to correct angles to establish ideal sensing zones as disclosed in the detailed description of FIG. 6B.

Figure 6B:
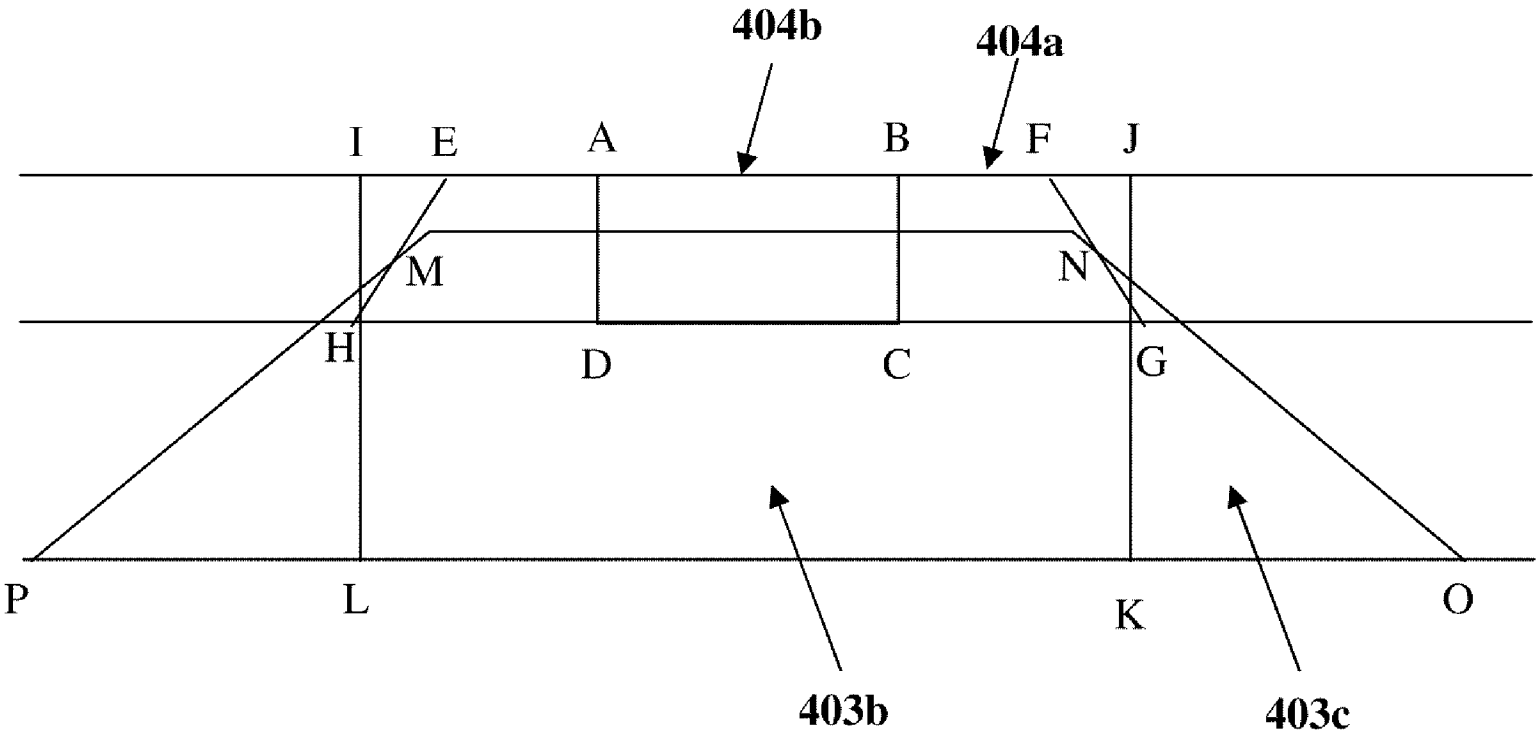
FIG. 6B exemplarily illustrates sensing zones established by the sensing device with the Fresnel lens.

FIG. 6B exemplarily illustrates sensing zones 403*b*, 403*c*, 404*a*, and 404*b* established by the sensing device 201, for example, a PIR sensor 201*a*, with the Fresnel lens 601. The Fresnel lens 601 is mounted on the PIR sensor 201*a* so that the X-axis 602 of the Fresnel lens 601 is parallel to the X-axis 602 of the PIR sensor 201*a*. As exemplarily illustrated in FIG. 6B, the PIR sensor 201*a* with the Fresnel lens 601 establishes an outer sensing zone 403*c* defined by the trapezoid MNOP, where the length of the side MN is, for example, about 285 inches, the length of the side OP is, for example, about 674 inches, and the height of the trapezoid MNOP is, for example, about 156.6 inches. By adjusting the sensor sensitivity controller 202*i* of the control unit 202 exemplarily illustrated in FIG. 5, the sensitivity of the PIR sensor 201*a* is adjusted to establish an ideal outer sensing zone 1 403*b* defined by the rectangle IJKL. The rectangle IJKL has, for example, a length of about 360 inches and a width of about 180 inches. The PIR sensor 201*a* with the Fresnel lens 601 establishes an inner sensing zone 404*a* defined by the trapezoid EFGH, where the length of the side EF is, for example, about 293 inches, the length of side GH is, for example, about 360 inches, and the height of the trapezoid EFGH is, for example, about 70 inches. By adjusting the sensor sensitivity controller 202*i* of the control unit 202 exemplarily illustrated in FIG. 5, the sensitivity of the PIR sensor 201*a* is adjusted to establish an ideal inner sensing zone 1 404*b* defined by the rectangle ABCD. The rectangle ABCD has, for example, a length of about 140.75 inches and a width of about 70 inches. To establish the desired sensing zones 403*b* and 404*b*, the sensing devices 201 are set in predetermined positions on a housing 701 of the control unit 202 as exemplarily illustrated in FIG. 7A.

Figure 7A:
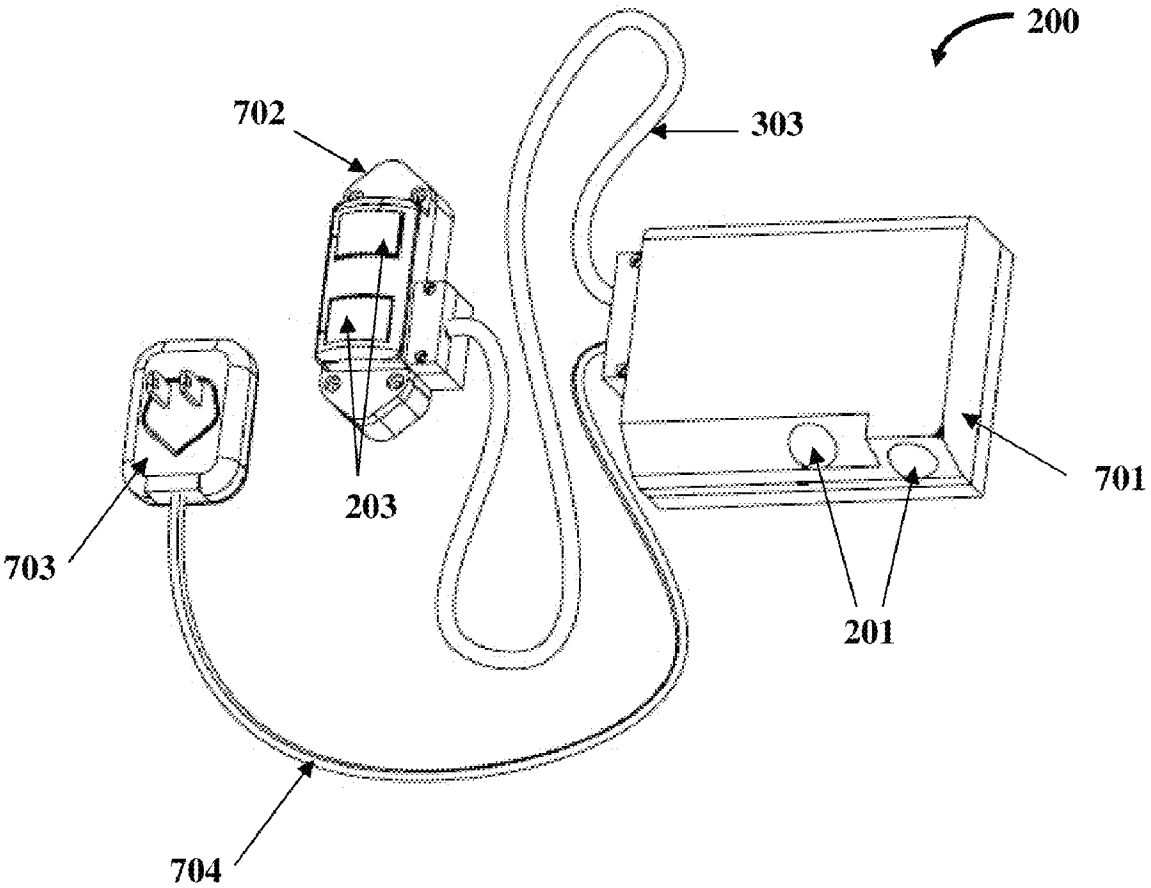
FIGS. 7A-7B exemplarily illustrate perspective views of the collision alert system.
Figure 7B:
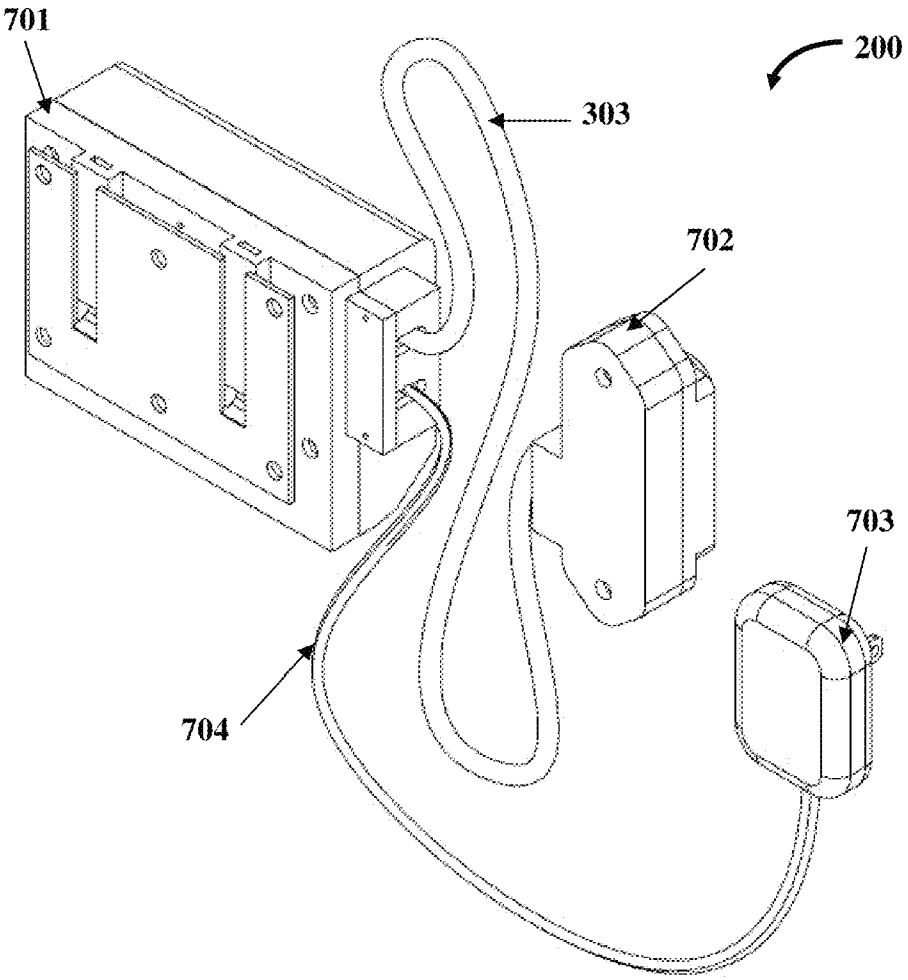
Figure 8A:
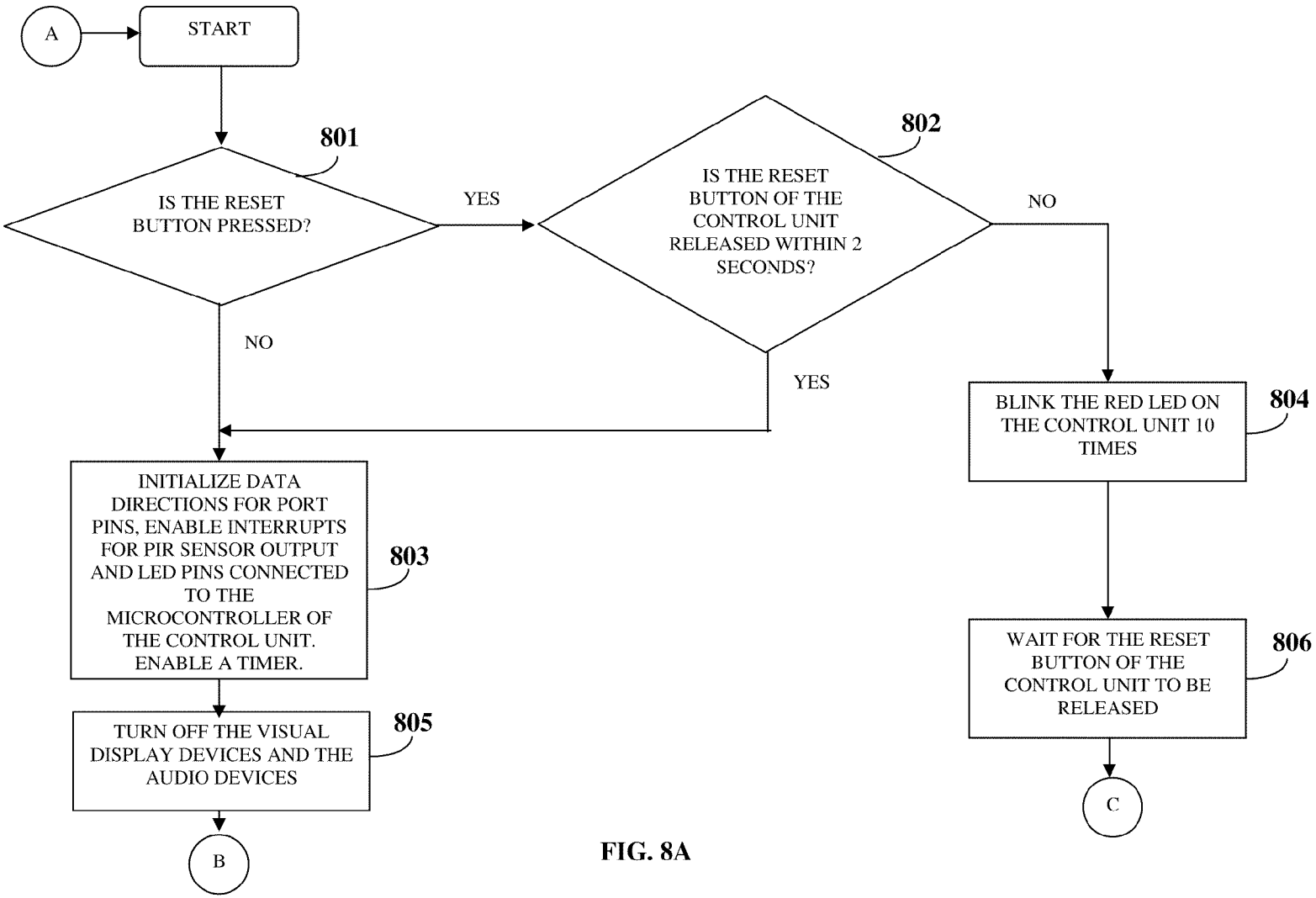
FIGS. 8A-8E exemplarily illustrate a flow chart comprising the steps for generating an alert for a possible collision between objects and a swinging barrier.
Figure 8B:
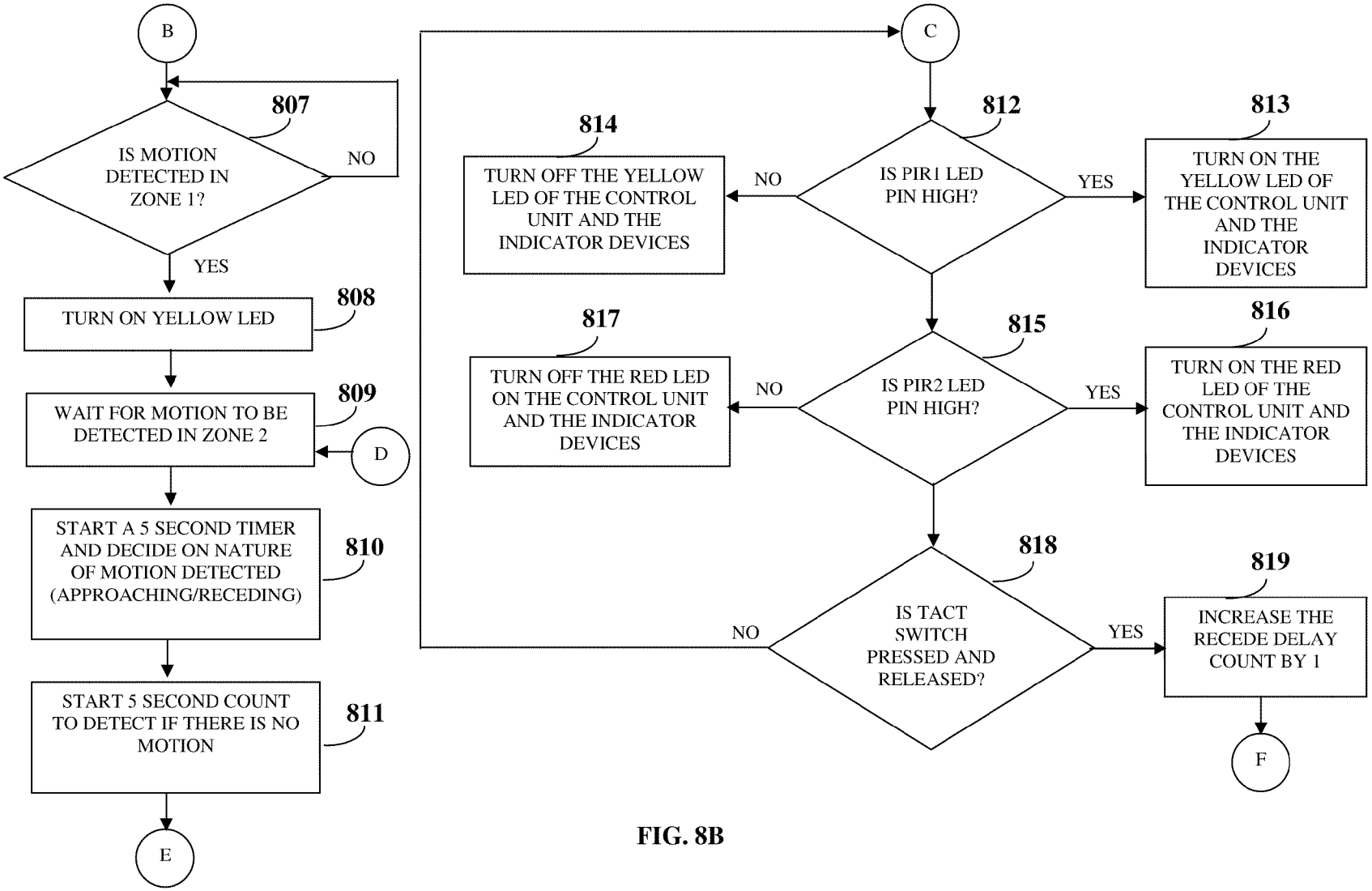
Figure 8C:
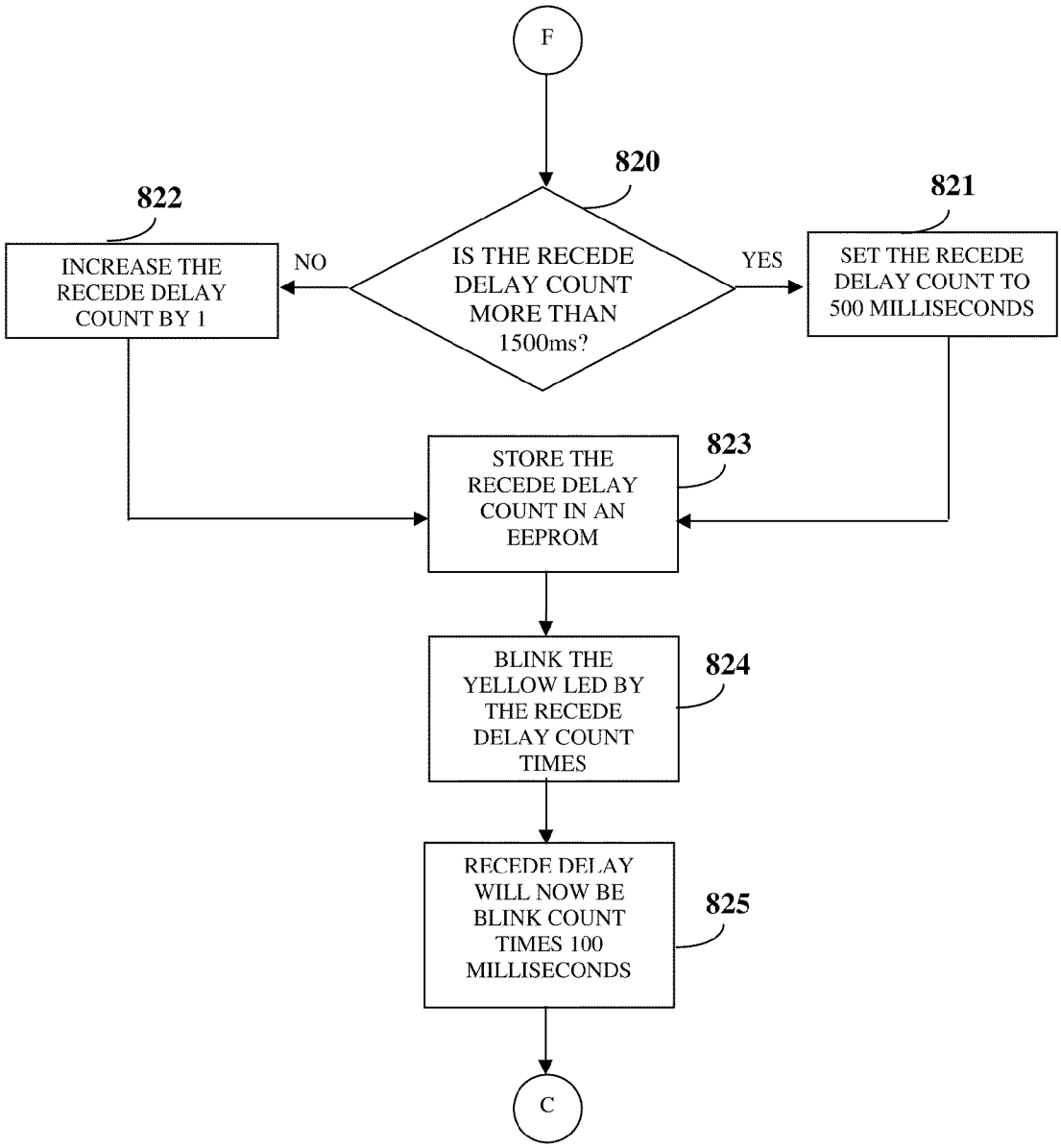
Figure 8D:
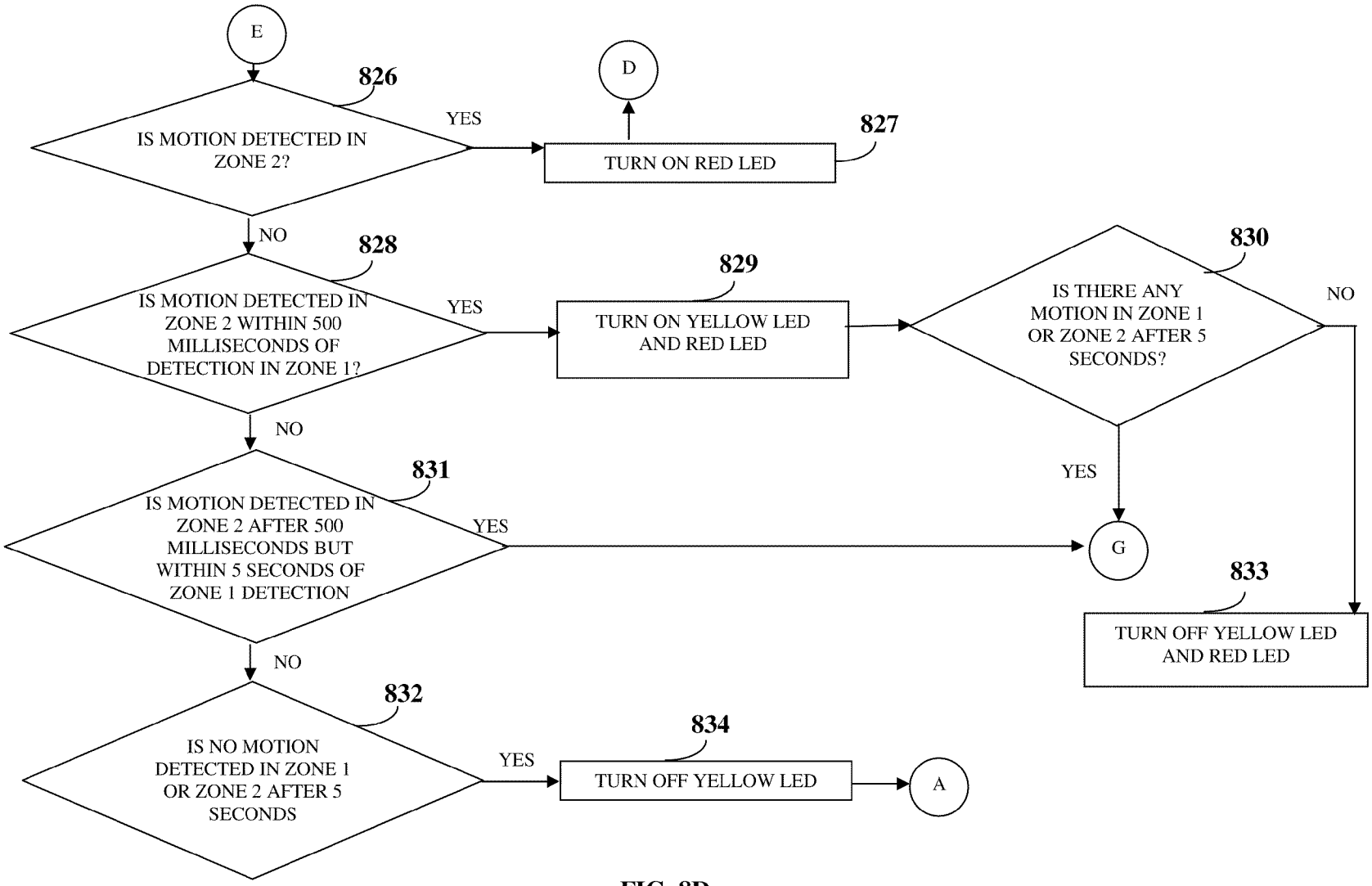
Figure 8E:
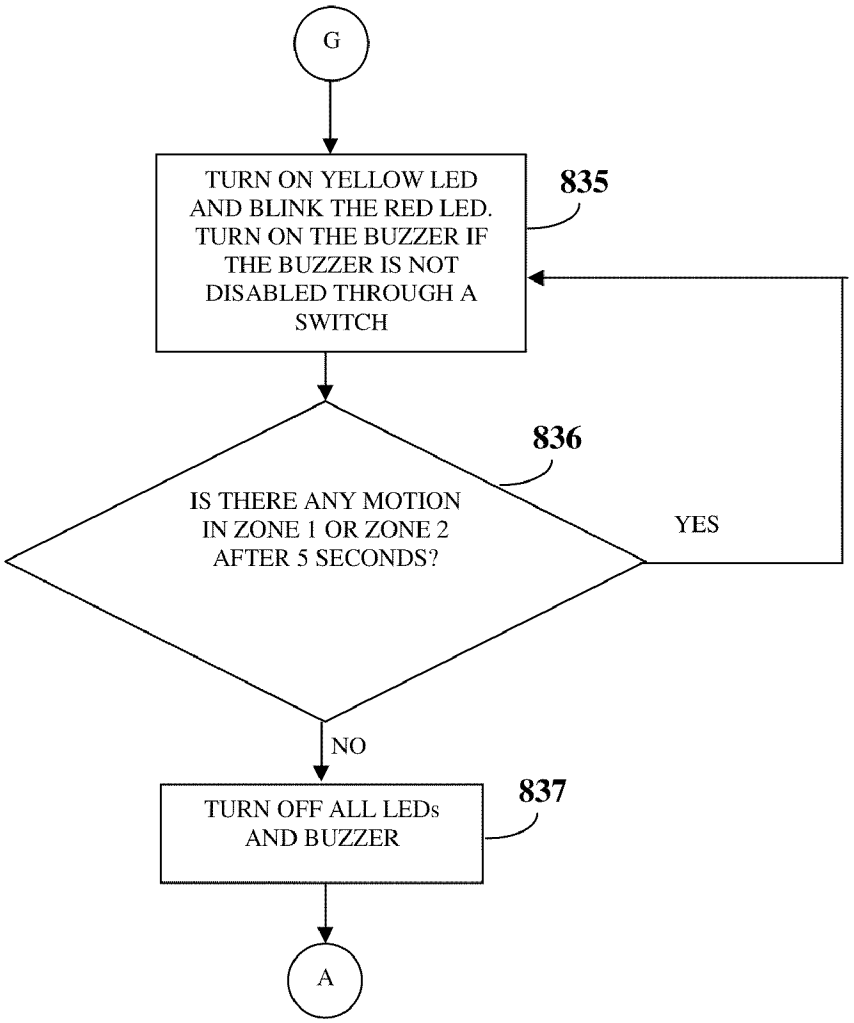

FIGS. 7A-7B exemplarily illustrate perspective views of the collision alert system 200. The components 201, 202, and 203 of the collision alert system 200 are incorporated in one or more individual and combined housings 701 and 702 that can be detachably attached at the entry area and the exit area of the swinging barrier 402. The control unit 202 of the collision alert system 200 is incorporated in a housing 701 and attached to, for example, the side 402*a* of the swinging barrier 402. The sensing devices 201 of the collision alert system 200 are incorporated in the housing 701 of the control unit 202 and communicate with the microcontroller 202*a* of the control unit 202 via the sensor interface 202*b* through the electrical cable 501 as exemplarily illustrated in FIG. 5. The sensing devices 201 are positioned at predetermined positions in the housing 701 of the control unit 202 to establish the desired sensing zones 403 and 404.

The indicator devices 203, for example, the visual display devices 203*a* such as the red LED and the yellow LED are housed within another housing 702 and connected to the control unit 202 via the electrical cable 303. The indicator devices 203 communicate with the microcontroller 202*a* of the control unit 202 via the indicator board interface 202*g* as exemplarily illustrated in FIG. 5. The indicator devices 203 receive the on/off alert signal from the control unit 202 via the indicator board interface 202*g*. A power adaptor 703, for example, an alternating current (AC) or a direct current (DC) power adaptor is connected to the control unit 202 via an electrical cable 704. The power adaptor 703 is connected to the power supply 502, which is used to power up the sensing devices 201, the control unit 202, and the indicator devices 203 of the collision alert system 200. The power adaptor 703 powers the indicator devices 203 via the indicator board interface 202*g*.

FIGS. 8A-8E exemplarily illustrate a flow chart comprising the steps for generating an alert for a possible collision between objects 401 and a swinging barrier 402. The collision alert system 200 comprises the sensing devices 201, the control unit 202, and the indicator devices 203 as disclosed in the detailed description of FIG. 1. In the collision alert system 200 disclosed herein, the sensing devices 201 comprise, for example, a pair of passive infrared (PIR) sensors 201*a* namely PIR 1 and PIR 2. A user adjusts the sensitivity of PIR 1 and PIR 2 such that PIR 1 is sensitive to motion in zone 1 403 and PIR 2 is sensitive to motion in zone 2 404 as disclosed in the detailed description of FIG. 5. The user mounts PIR 1 and PIR 2 proximal to the swinging barrier 402 such that their area of sensitivity is along the X-axis 602 of PIR 1 and PIR 2 respectively to detect presence of stationary objects 405, approaching movements of approaching objects 405, and receding movements of receding objects 405 in zone 1 403 and zone 2 404 respectively as exemplarily illustrated in FIG. 6. The user also adjusts the recede delay to about 500 milliseconds as disclosed in the detailed description of FIG. 5. The indicator devices 203 comprise visual display devices 203*a* such as yellow LEDs and red LEDs on the control unit 202 and the back door module 302, and audio devices 203*b* such as a buzzer in the back door module 302.

The user resets the control unit 202 by pressing a reset button on the control unit 202. The collision alert system 200 checks 801 whether the user pressed the reset button. If the user pressed the reset button, the collision alert system 200 checks 802 whether the user releases the reset button within two seconds. If the user does not release the reset button within two seconds, the red LED on the control unit 202 blinks 804 ten times. The collision alert system 200 then waits 806 for the user to release the reset button of the control unit 202. The control unit 202 then checks 812 whether the PIR 1 LED pin of the microcontroller 202*a* is high. If the PIR 1 LED pin of the microcontroller 202*a* is high, the control unit 202 generates and transmits an alert signal to the yellow LEDs to turn on 813 the yellow LEDs. If the PIR 1 LED pin of the microcontroller 202*a* is not high, the control unit 202 generates and transmits an alert signal to the yellow LEDs to turn off 814 the yellow LEDs. The control unit 202 then checks 815 whether the PIR 2 LED pin of the microcontroller 202*a* is high. If the PIR 2 LED pin of the microcontroller 202*a* is high, the control unit 202 generates and transmits an alert signal to the red LEDs to turn on 816 the red LEDs. If the PIR 2 LED pin of the microcontroller 202*a* is not high, the control unit 202 generates and transmits an alert signal to the red LEDs to turn off 817 the red LEDs. The control unit 202 then checks 818 whether the user has pressed and released the tact switch 202*f*. If the user has not pressed and released the tact switch 202*f*, the process returns to step 812. If the user has pressed and released the tact switch 202*f*, the control unit 202 increases 819 the recede delay count by one.

The control unit 202 then checks 820 whether the recede delay count is more than 1500 milliseconds. If the recede delay count is more than 1500 ms, the control unit 202 sets 821 the recede delay count to 500 milliseconds. If the recede delay count is not more than 1500 ms, the control unit 202 increases 822 the recede delay count by one. The control unit 202 stores 823 the recede delay count in a memory unit, for example, an electrically erasable programmable read only memory (EEPROM) of the control unit 202. The control unit 202 generates and transmits an alert signal to the yellow LED to cause the yellow LED to start blinking 824 a few times to indicate the recede delay count. The recede delay is the number of blinks multiplied 825 by 100 milliseconds. The process then returns to step 812.

If the user does not release the reset button in two seconds, the collision alert system 200 initializes 803 data directions for port pins of the microcontroller 202*a*, enable interrupts for the PIR sensor output and the LED pins connected to the microcontroller 202*a* of the control unit 202. The collision alert system 200 enables 803 a timer for measuring the delay of motion detection in zone 1 403 and zone 2 404. The collision alert system 200 turns off 805 all the visual display devices 203*a* and the audio devices 203*b*.

The control unit 202 of the collision alert system 200 determines 807 whether motion of an object 405 is detected in zone 1 403 by PIR 1. If motion is not detected in zone 1 403, the control unit 202 continues to monitor and check whether motion of the object 405 is detected in zone 1 403 by PIR 1.

If motion is detected in zone 1 403 by PIR 1, the control unit 202 generates and transmits an alert signal to the yellow LED to turn on 808 the yellow LED. The control unit 202 then waits 809 for motion to be detected in zone 2 404 by PIR 2. The control unit 202 starts 810 a 5 second timer to decide on the nature of the motion detected, that is, to determine whether the motion detected is an approaching movement or a receding movement. The control unit 202 then starts 811 a 5 second count to detect if there is any motion in zone 1 403 or zone 2 404.

The control unit 202 checks 826 whether motion is detected in zone 2 404 by PIR 2. If there is motion in zone 2 404, the control unit 202 generates and transmits an alert signal to the red LED to turn on 827 the red LED and the process returns to step 809. If there is no motion is zone 2 404, the control unit 202 checks 828 whether motion is detected in zone 2 404 by PIR 2 within 500 milliseconds of detection of motion in zone 1 403. If there is motion detected in zone 2 404 within 500 milliseconds of detection of motion in zone 1 403, the control unit 202 generates and transmits an alert signal to the yellow LED and the red LED to turn them on 829. The control unit 202 then checks 830 whether there is any motion detected in zone 1 403 or zone 2 404 after 5 seconds. If there is no motion detected in zone 1 403 or zone 2 404 after 5 seconds, the control unit 202 turns off 833 the yellow LED and the red LED. If there is motion detected in zone 1 403 or zone 2 404 after 5 seconds, the process then continues to step 835.

If there is no motion detected in zone 2 404 within 500 milliseconds of detection of motion in zone 1 403, the control unit 202 checks 831 whether motion is detected in zone 2 404 after 500 milliseconds but within 5 seconds of detection of motion in zone 1 403. If there is motion detected in zone 2 404 after 500 milliseconds but within 5 seconds of detection of motion in zone 1 403, the control unit 202 generates and transmits an alert signal to the yellow LED, the red LED, and the buzzer to turn on 835 the yellow LED, blink 835 the red LED, and turn on 835 the buzzer if the buzzer is not disabled through the tact switch 202*f* or an external switch. The control unit 202 then checks 836 whether there is any motion detected in zone 1 403 or zone 2 404 after 5 seconds. If there is no motion detected in zone 1 403 or zone 2 404 after 5 seconds, the control unit 202 turns off 837 all the LEDs and the buzzer and the process repeats from step 801. If there is motion detected in zone 1 403 or zone 2 404 after 5 seconds, the yellow LED remains on 835, the red LED continues to blink 835, and the buzzer continues to remain on 835. If there is no motion detected in zone 2 404 after 500 milliseconds but within 5 seconds of detection of motion in zone 1 403, the control unit 202 checks 832 whether there is any motion detected in zone 1 403 or zone 2 404 after 5 seconds. If there is no motion in zone 1 403 or zone 2 404 after 5 seconds, the control unit 202 turns off 834 the yellow LED and the process repeats from step 801.

Figure 9:
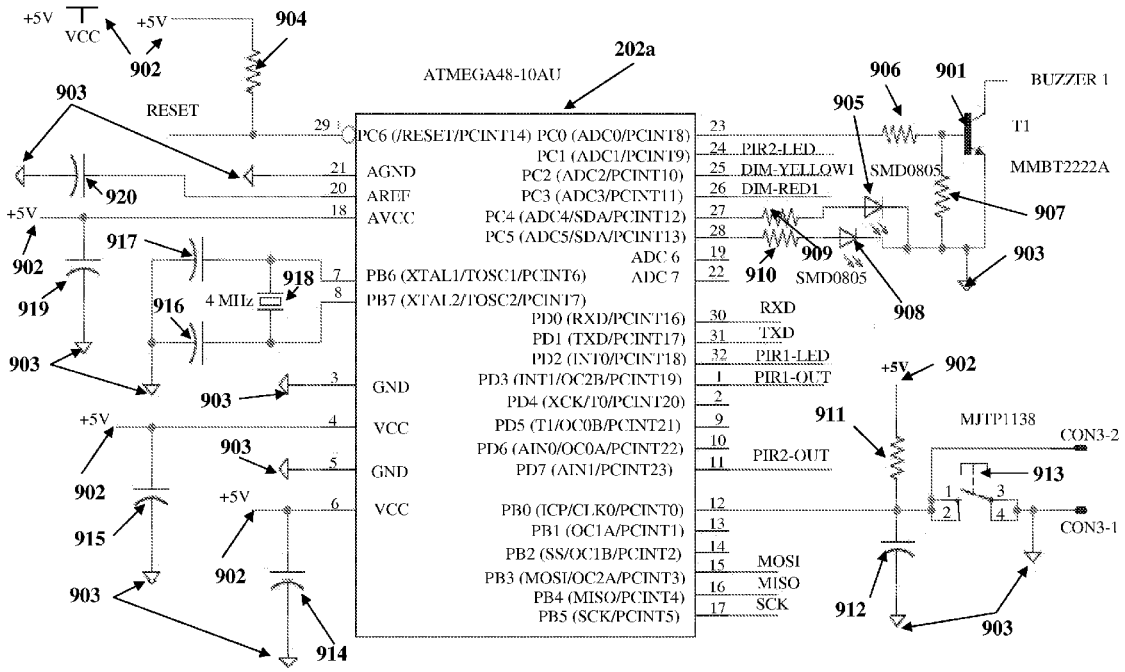
FIG. 9 exemplarily illustrates a circuit diagram of a microcontroller of the control unit that generates an alert for a possible collision between objects and a swinging barrier.

FIG. 9 exemplarily illustrates a circuit diagram of a microcontroller 202*a* of the control unit 202 that generates an alert for a possible collision between objects 401 and a swinging barrier 402. The microcontroller 202*a* of the control unit 202 is, for example, a microcontroller with Atmel model number ATMEGA48-10AU of Atmel® Corporation. The microcontroller 202*a* can be programmed to control different functions of the control unit 202. The microcontroller 202*a* can be powered up using low voltages for conserving power. For example, a 5-volt (5V) power supply 902 is applied to the VCC and AVCC pins, for example, pins 4, 6 and, 18 of the microcontroller 202*a*. In order to prevent noise and fluctuations in the power supply voltage from affecting the operation of the microcontroller 202*a*, the power supply voltage of 5V to the microcontroller 202*a* is filtered by multiple bypass capacitors 914, 915, 919, and 920. The 5-volt power supply 902 is also used to disable unused inputs as well as to pull various control pins high for proper operation. For example, the 5-volt power supply 902 is applied to the active low pin 29, that is, the PC6(/RESET/PCINT14) pin, of the microcontroller 202*a* by way of a pull-up resistor 904. The microcontroller 202*a* is adapted to operate at 4 megahertz (MHz) at 5-volt power supply 902. A clock generator 918 provides a 4 MHz clock signal to clock input pins 7 and 8, that is, the PB6 (XTAL1/TOSC1/PCINT6) pin and the PB7(XTAL2/TOSC2/PCINT7) pin respectively of the microcontroller 202*a* by way of a pair of capacitors 916 and 917.

The microcontroller 202*a* is interfaced to a general purpose NPN amplifier 901, for example, MMBT2222A of Fairchild Semiconductor™ Incorporated that connects to an audio device 203*b*, for example, a buzzer. The NPN amplifier 901 is connected to the pins 23, 27, and 28, that is, the PC0(ADC0/PCINT8) pin, the PC4(ADC4/SDA/PCINT12) pin, and the PC5(ADC5/SDA/PCINT13) pin, respectively of the microcontroller 202*a*. The NPN amplifier 901 comprises an emitter terminal, a collector terminal, and a base terminal. The base terminal is connected to pin 23 of the microcontroller 202*a* through a resistor 906. The base terminal is also connected to pin 28 of the microcontroller 202*a* through a resistor 907. The emitter terminal is connected to the pin 28 of the microcontroller 202*a* through a resistor 910 and a surface mount LED 908, for example, SMD0805. Another surface mount LED 905 is connected to the pin 27 of the microcontroller 202*a* through a resistor 909.

The microcontroller 202*a* is further interfaced to an electronic component, for example, a switch 913. The switch 913 is a tact switch 202*f*, for example, MJTP1138 913 of APEM. The switch 913 is used to calibrate the sensing devices 201 in the diagnostic mode as disclosed in the detailed description of FIG. 5. The switch 913 is connected to a 5-volt power supply 902 by way of a pull-up resistor 911 and a capacitor 912 that prevents noise and fluctuations in the power supply voltage from affecting the operation of the switch 913. The switch 913 is connected to the pin 12, that is, the PB0(ICP/CLK0/PCINT0) pin of the microcontroller 202*a*. The sensing devices 201, for example, the PIR sensors 201*a* are connected to the pins 32, 1, 24, and 11, that is, the PD2(INT0/PCINT18) pin, the PD3(INT1/OC2B/PCINT19) pin, the PC1(ADC1/PCINT9) pin, and the PD7(AIN1/PCINT23) pin respectively. The microcontroller 202*a* takes in inputs from the PIR sensors 201*a* and the switch 913. The programmer connector 202*c* of the control unit 202 is connected to the pins 15, 16, and 17, that is, the PB3(MOSI/OC2A/PCINT3) pin, the PB4 (MISO/PCINT4) pin, and the PB5(SCK/PCINT5) pin respectively of the microcontroller 202*a*. The UART connector 202*d* of the control unit 202 is connected to the pins 30 and 31, that is, the PD0(RXD/PCINT16) pin and the PD1(TXD/PCINT17) pin respectively of the microcontroller 202*a*.

The indicator devices 203, for example, the yellow LED and the red LED are connected to the pins 25 and 26, that is, the PC2(ADC2/PCINT10) pin and the PC3(ADC3/PCINT11) pin respectively of the microcontroller 202*a* via the indicator board interface 202*g*. The indicator devices 203 selectively indicate 107 a possible collision between the objects 401 and the swinging barrier 402 based on the presence of the stationary objects 405, the approaching movements of the approaching objects 405, and the receding movements of the receding objects 405 in the established sensing zones 403 and 404, on receiving the alert signal from the microcontroller 202*a*. For example, if the pin 32 of the microcontroller 202*a* is high, the microcontroller 202*a* generates and transmits an alert signal to the yellow LED to turn on the yellow LED. If the pin 32 of the microcontroller 202*a* is not high, the microcontroller 202*a* generates and transmits an alert signal to the yellow LED to turn off the yellow LED. If the pin 24 of the microcontroller 202*a* is high, the control unit 202 generates and transmits an alert signal to the red LEDs to turn on the red LED. If the pin 24 of the microcontroller 202*a* is not high, the microcontroller 202*a* generates and transmits an alert signal to the red LED to turn off 817 the red LED. The microcontroller 202*a* executes the program and outputs the alert signal to the indicator devices 203, for example, the LEDs and the buzzer. The alert signal conveys, for example, whether to turn on the LEDs, when to flash the red LED, etc.

Figure 10:
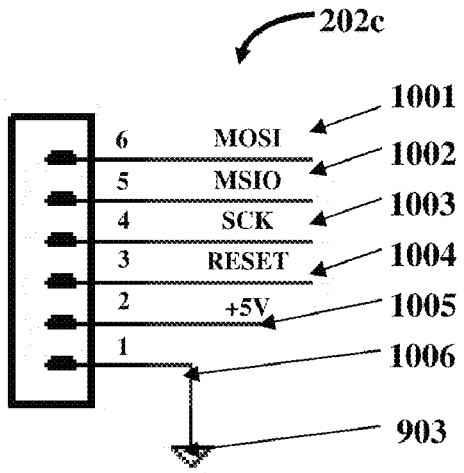
FIGS. 10-12 exemplarily illustrate circuit diagrams of components of the control unit.
Figure 11:
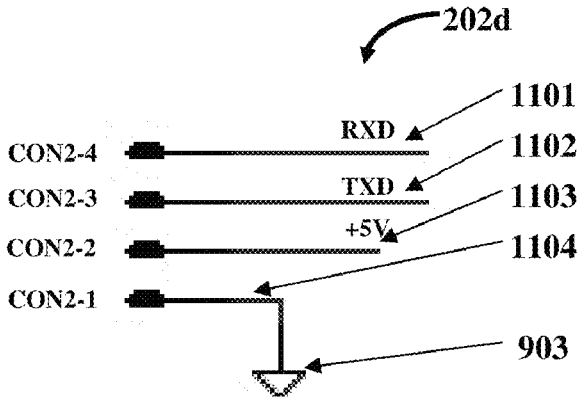
Figure 12:
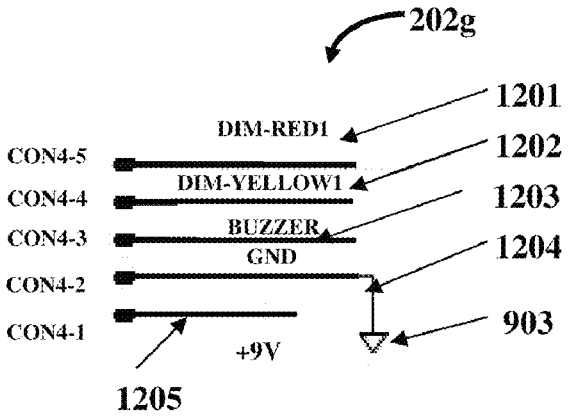

FIGS. 10-12 exemplarily illustrate circuit diagrams of components of the control unit 202. The components of the control unit 202 comprise, for example, the programmer connector 202*c*, the universal asynchronous receiver/transmitter (UART) connector 202*d*, the indicator board interface 202*g*, etc.

As exemplarily illustrated in FIG. 10, the pin 6 1001 of the programmer connector 202*c* is connected to the pin 15, that is, the PB3(MOSI/OC2A/PCINT3) pin of the microcontroller 202*a*, the pin 5 1002 of the programmer connector 202*c* is connected to the pin 16, that is, the PB4(MISO/PCINT4) pin of the microcontroller 202*a*, and the pin 4 1003 of the programmer connector 202*c* is connected to the pin 17, that is, the PB5(SCK/PCINT5) pin of the microcontroller 202*a*. The pin 3 1004 of the programmer connector 202*c* is connected to the pin 29, that is, the PC6(/RESET/PCINT14) pin of the microcontroller 202*a*, the pin 2 1005 of the programmer connector 202*c* is connected to the 5-volt power supply 902 at the VCC pin 4 or 6 of the microcontroller 202*a*, and the pin 1 1006 is connected to an electrical ground 903. The programmer connector 202*c* circuit connects the microcontroller 202*a* to, for example, a computer system (not shown) through a serial port which allows data transfer from the computer system to the microcontroller 202*a* via the pins, for example, the data input pin MOSI, the data output pin MISO, the clock input pin SCK, and the RESET pin of the microcontroller 202*a*. The RESET pin of the microcontroller 202*a* is used to activate serial programming of the microcontroller 202*a*.

As exemplarily illustrated in FIG. 11, the CON2-4 pin 1101 of the UART connector 202*d* is connected to the pin 30, that is, the PD0(RXD/PCINT16) pin of the microcontroller 202*a*, the CON2-3 pin 1102 of the UART connector 202*d* is connected to pin 31, that is, the PD1(TXD/PCINT17) pin of the microcontroller 202*a*, the CON2-2 pin 1103 of the UART connector 202*d* is connected to the 5-volt power supply 902 at the VCC pin 4 or 6 of the microcontroller 202*a*, and the CON2-1 pin 1104 of the UART connector 202*d* is connected to the electrical ground 903. The circuit connections as exemplarily illustrated in FIG. 11 can be used for a serial data transfer with the computer system.

As exemplarily illustrated in FIG. 12, the CON4-5 pin 1201 of the indicator board interface 202*g* is connected to the pin 26, that is, the PC3(ADC3/PCINT11) pin of the microcontroller 202*a*, the CON4-4 pin 1202 of the indicator board interface 202*g* is connected to the pin 25, that is, the PC2 (ADC2/PCINT10) pin of the microcontroller 202*a*, the CON4-3 pin 1203 is connected to a buzzer, the CON4-2 pin 1204 of the indicator board interface 202*g* is connected to the electrical ground 903, and the CON4-1 pin 1205 of the indicator board interface 202*g* is connected to a 9-volt power supply. The indicator board interface 202*g* comprises power in conjunction with signal outputs to the indicator devices 203, for example, the yellow LED, the red LED, the buzzer, etc. The alert signal, along with the power is sent to the indicator devices 203 through the indicator board interface 202*g* to convey to each of the indicators 203 when to turn on and off.

Figure 13:
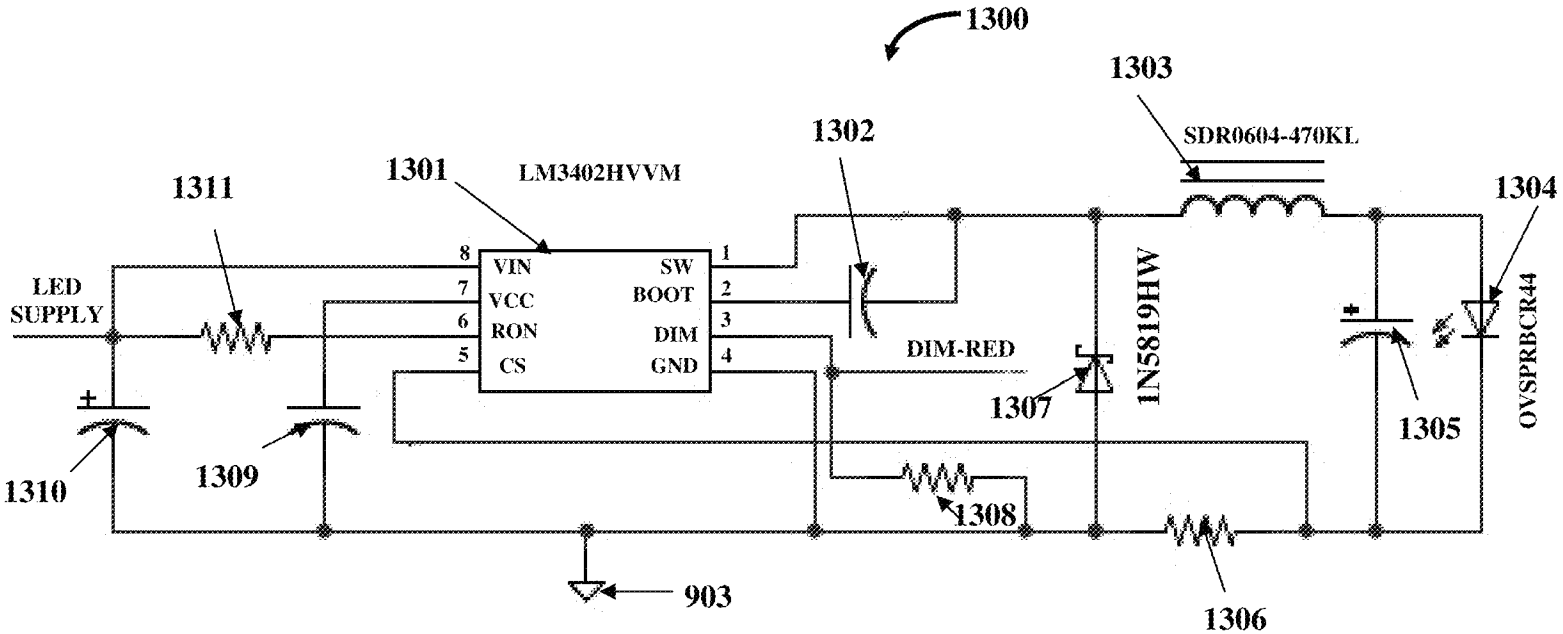
FIGS. 13-15 exemplarily illustrate circuit diagrams of the front door module of the collision alert system.
Figure 14:
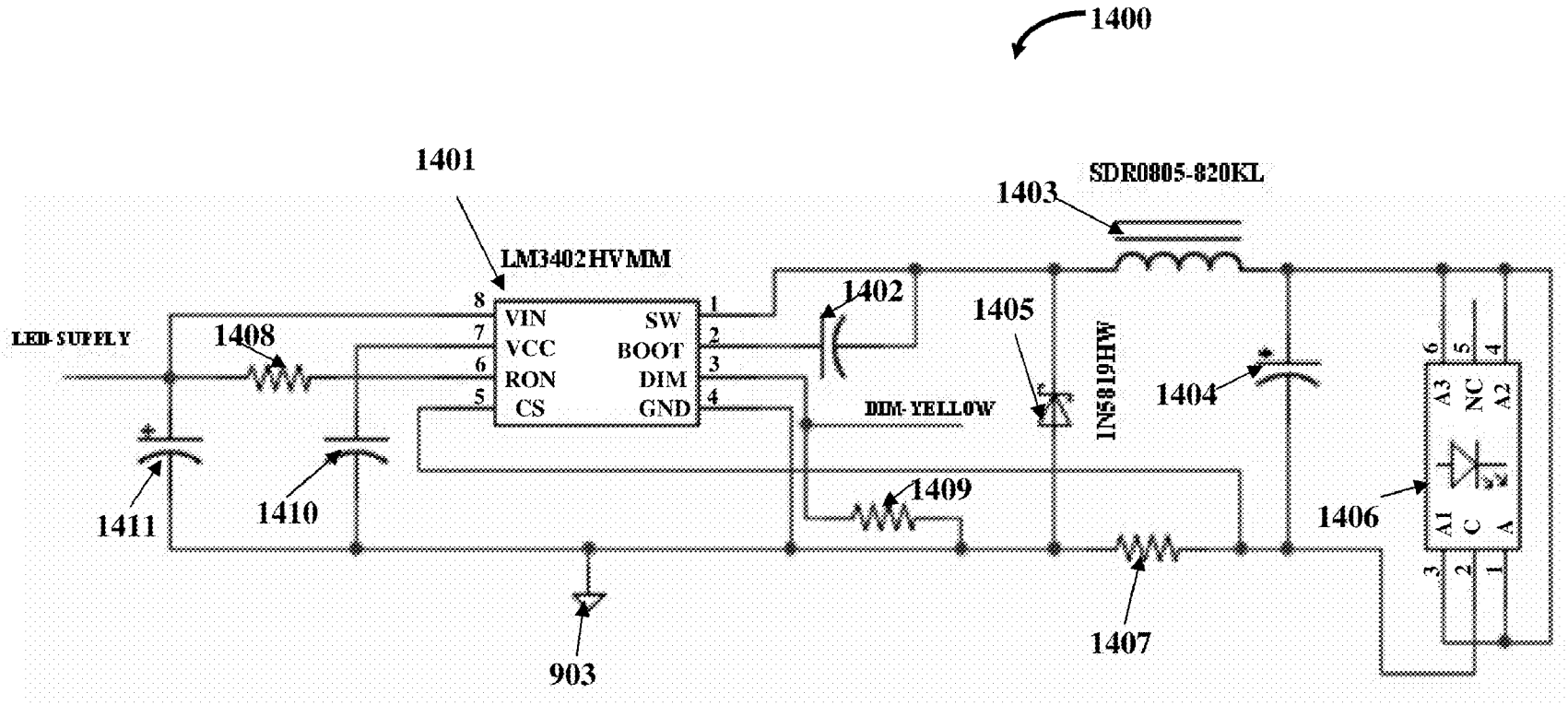
Figure 15:
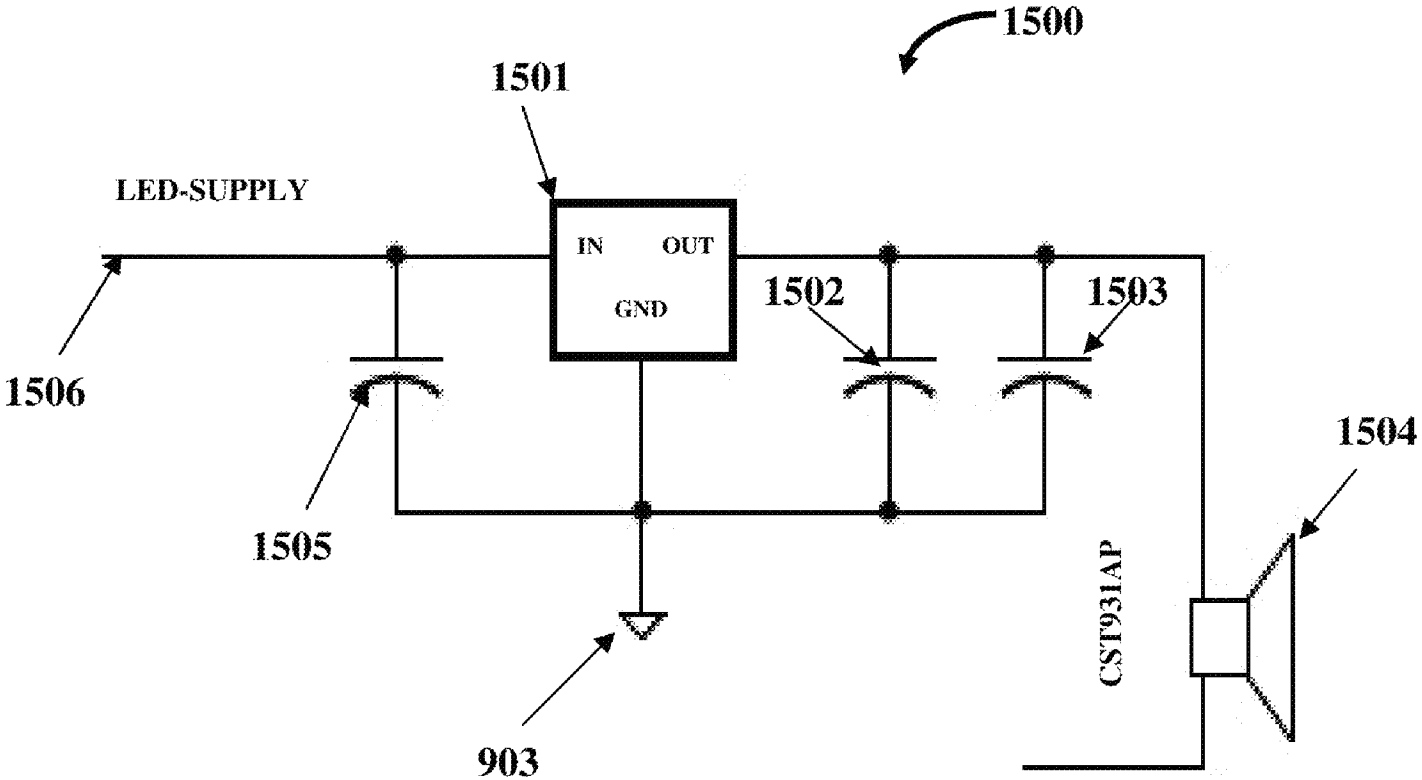

FIGS. 13-15 exemplarily illustrate circuit diagrams of the front door module 301 of the collision alert system 200. The front door module 301 comprises, for example, a red LED driver circuit 1300 that drives the red LED 1304, a yellow LED driver circuit 1400 that drives the yellow LED 1406, and a buzzer circuit 1500 that drives the buzzer 1504.

As exemplarily illustrated in FIG. 13, the red LED driver circuit 1300 comprises, for example, a 0.5 A constant current buck regulator 1301 such as LM3402HVMM of National Semiconductor, resistors 1306, 1308, and 1311, capacitors 1302, 1305, 1309, and 1310, a schottky diode 1307 such as 1N5819HW of Diodes Incorporated®, an inductor 1303, a red LED 1304 such as OVSPRBCR44 of Optek Technology. The regulator 1301 LM3402HVMM is driven by the power supply. The red LED driver circuit 1300 receives the alert signal and power from the printed circuit board of the control unit 202 via the indicator board interface 202*g*. In the red LED driver circuit 1300, the alert signal is filtered and cleaned to provide a constant voltage and current at a correct power to the high output red LED 1304, which ensures the consistency of intensities of the red LED 1304.

As exemplarily illustrated in FIG. 14, the yellow LED driver circuit 1400 comprises, for example, a 0.5 A constant current buck regulator 1401 such as LM3402HVMM of National Semiconductor, driven by a power supply, resistors 1407, 1408, and 1409, capacitors 1402, 1404, 1410, and 1411, the schottky diode 1405 such as 1N5819HW of Diodes Incorporated®, an inductor 1403, a yellow LED 1406 such as LY-G6SP-BBDB-36-1 of OSRAM Opto Semiconductors Inc. The yellow LED driver circuit 1400 receives the alert signal and power from the printed circuit board of the control unit 202 via the indicator board interface 202*g*. In the yellow LED driver circuit 1400, the alert signal is filtered and cleaned to provide a constant voltage and current at the correct power to the high output yellow LED 1406, which ensures the consistency of the intensities of the yellow LED 1406.

The buzzer circuit 1500 that drives the buzzer 1504 is exemplarily illustrated in FIG. 15. The buzzer circuit 1500 comprises, for example, an adjustable micro power voltage regulator 1501 such as LP2950ACZ Of National Semiconductor and a magnetic buzzer 1504 such as CST931AP of CUI, Inc. In order to prevent noise and fluctuations in the buzzer circuit 1500 driven by the LED supply 1506 voltage from affecting the operation the buzzer circuit 1500, the LED supply 1506 voltage of the buzzer circuit 1500 is filtered by multiple bypass capacitors 1502, 1503, and 1505 that in turn connect to the magnetic buzzer 1504. The buzzer circuit 1500 receives the alert signal and power from the printed circuit board of the control unit 202 via the indicator board interface 202*g*.

Figure 16:
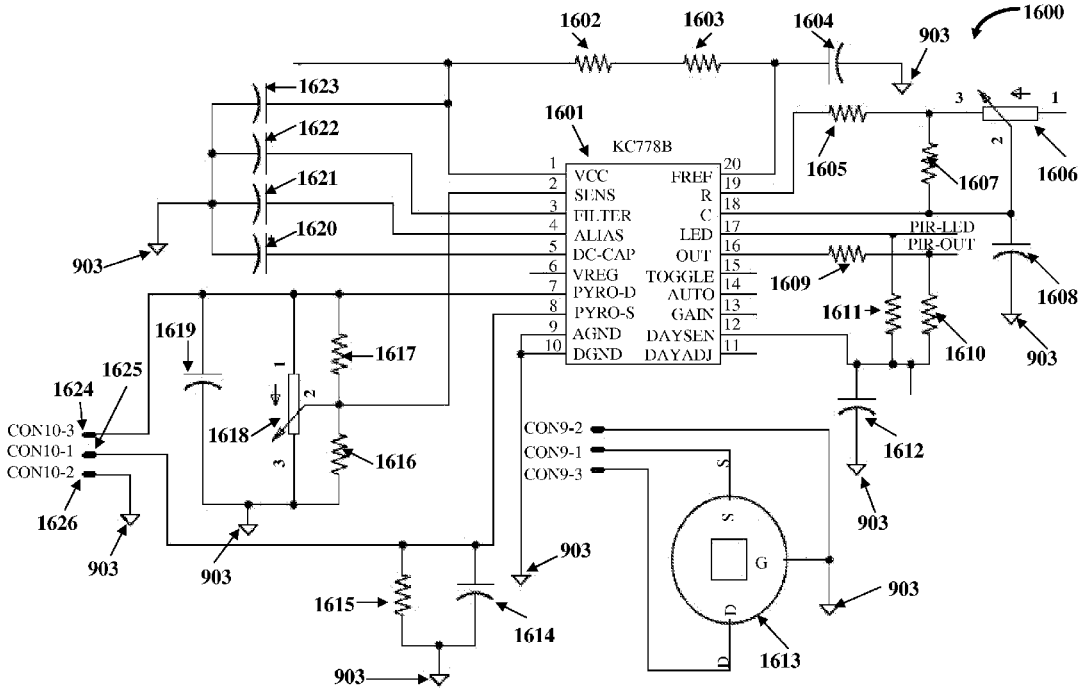
FIG. 16 exemplarily illustrates a circuit diagram for a sensing device circuit of the collision alert system.

FIG. 16 exemplarily illustrates a circuit diagram for a sensing device circuit 1600, of the collision alert system 200. The sensing device circuit 1600 comprises a master PIR controller 1601 and a sensing device 201, for example, a PIR sensor 201*a*. A master PIR controller 1601, for example, KC778B of COMedia Ltd. controls the PIR sensor 201*a*. As exemplarily illustrated in FIG. 16, the pin 1, that is, the VCC pin of the master PIR controller 1601 is connected to a regulated power supply of 5V. The pin 1 is also connected the electrical ground 903 via a bypass capacitor 1623. The pin 2 of the master PIR controller 1601 is a sensitivity adjust pin that is used to adjust the sensitivity threshold of motion comparators. The pin 2 is connected to a variable resistor 1618 whose resistance can be varied. When the voltage on the pin 2 is equal to the pyro drain reference voltage on the pin 7 of the master PIR controller 1601, the sensitivity of the PIR sensor 201*a* is minimum. When the voltage on the pin 2 of the master PIR controller 1601 is at the electrical ground 903, the sensitivity of the PIR sensor 201*a* is maximum. Intermediate voltages on the pin 2 provide the PIR sensor 201*a* with intermediate sensitivities. The pin 3 of the master PIR controller 1601, that is, an offset filter is connected to a capacitor 1622 that holds an average value of switched capacitor bandpass filter output. The PIR sensor 201*a* detects motion when the difference between the average value and the actual filter output is greater than the sensitivity setting. The pin 4 of the master PIR controller 1601 is an anti-alias filter, which is connected to a capacitor 1621 that provides low pass filtering of the PIR sensor input signal, thereby blocking input signals at and above the switching frequency of the switched capacitor bandpass filter. The pin 5 of the master PIR controller 1601 is a DC CAP that is connected to a capacitor 1620 that holds the average pyro source voltage. The average pyro source voltage value is compared with the actual detected value of the pyro source voltage and is amplified and coupled to the switched capacitor bandpass filter. The typical value of the capacitors 1622, 1621, and 1620 connected to pins 3, 4, and, 5 respectively of the master PIR controller 1601 is, for example, 10 micro farads. The capacitor 1620 connected to the pin 5 of the master PIR controller 1601 is a low leakage capacitor, for example, a tantalum capacitor.

The pin 6 is a voltage regulator output pin. The voltage regulator output pin outputs a voltage that can be used to directly drive an external NPN or PNP voltage regulator, or the gate of an external depletion mode JFET voltage regulator pass element. The pin 7 of the master PIR controller 1601 outputs a pyro drain reference voltage. The arrangement of the capacitor 1619 and the resistors 1616 and 1617 connected to the pin 7 serve to cancel noise and improve performance and reliability of the sensor interface 202*b*. The pyro drain reference voltage can also be divided down by an external potentiometer 1618 to supply the sensitivity adjust voltage to the pin 2.

The pin 8 of the master PIR controller 1601 is the pyro source input pin that receives a PIR input signal. The pins 9 and 10 of the master PIR controller 1601 are connected to the electrical ground 903. The pin 11 is the daylight adjustment and cadmium sulfide (CdS) input pin. The pin 12 of the master PIR controller 1601 is the input to a daylight sense amplifier and has a connection to the electrical ground 903 via the capacitor 1612. The pin 13 is the gain select tri-state input pin used to select the gain of the PIR sensor 201*a*. The pin 14 is the mode select tri-state input pin used to determine the operation of the PIR sensor 201*a*. The pin 15 is the mode select toggle input pin also used to determine the operation of the PIR sensor 201*a*. The pin 16 of the master PIR controller 1601 is an output pin used to turn the external load on or off and also drive small pulse relay through a capacitor. The pin 16 of the master PIR controller 1601 is connected to the pin 11 of the microcontroller 201*a* via a resistor 1609. The pin 16 of the master PIR controller 1601 is connected to the pin 12 of the master PIR controller 1601 via the resistor 1610. The pin 17 is the LED pin, which is driven by the output from the motion comparator through a current limiting resistor, thereby enabling the pin 17 to directly drive the LED motion indicator. The pin 17 of the master PIR controller 1601 is connected to the pin 24 of the microcontroller 201*a*. The pin 17 of the master PIR controller 1601 connects to the pin 12 of the master PIR controller 1601 via the resistor 1611. The pins 18 and 19 are input to and output of an off timer oscillator respectively. The pins 18 and 19 are connected to a pair of resistors 1605 and 1607 respectively, a variable resistor 1606, and a capacitor 1608. The pin 20 is the frequency reference oscillator input pin and is connected to VCC through the resistors 1602 and 1603 and a capacitor 1604 of predetermined values. This ensures that the oscillator frequency is fixed to a predetermined value. This oscillator frequency drives the switched capacitor bandpass filter and other internal timing delays. The output of the PIR sensor 201*a* are stored and averaged. When the average of the outputs of the PIR sensors 201*a* is outside of a threshold, the average of the outputs of the PIR sensors 201*a* is outputted back to the printed circuit board of the control unit 202 through the sensor interface 202*b*, showing that the output is massaged and verified.

CON10-31624 is connected to the pin 7 of the master PIR controller 1601. CON10-1 1625 is connected to the pin 8 via a parallel connection of a resistor 1615 and a capacitor 1614. CON10-2 1626 is connected to the electrical ground 903. The PIR sensor 201*a* is, for example, a pyroelectric infrared sensor 1613 such as RE200B-P.

Figure 17:
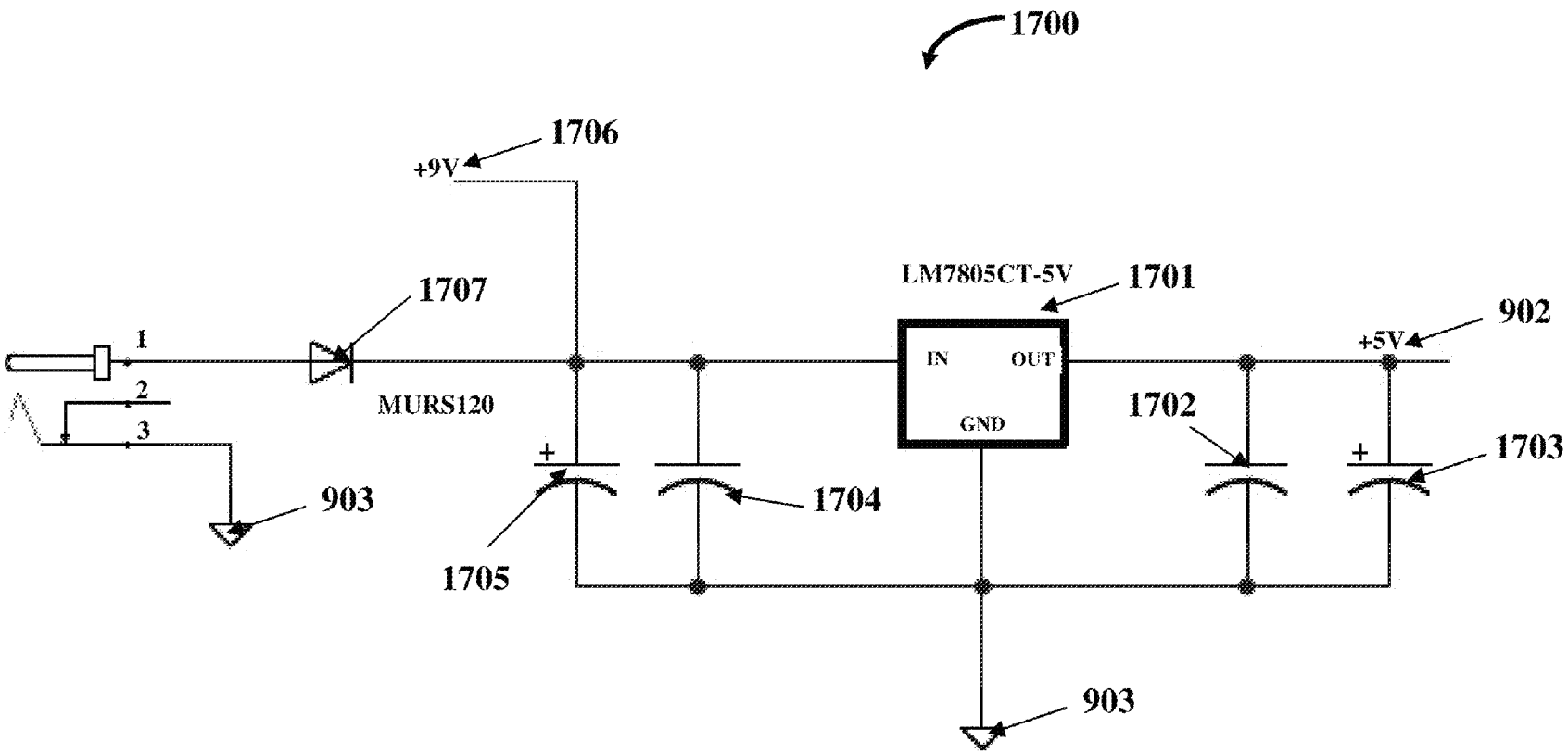
FIG. 17 exemplarily illustrates a circuit diagram for a power regulator circuit of the collision alert system.

FIG. 17 exemplarily illustrates a circuit diagram for a power regulator circuit 1700 of the collision alert system 200. The power regulator circuit 1700 comprises a 3 terminal 1 A positive voltage regulator 1701 such as LM7805 CT of National Semiconductor, a rectifier 1707 such as MURS120 of International Rectifier, etc. The power regulator circuit 1700 takes in the power for the collision alert system 200, cleans the power for consistent 9V power 1706 and outputs 5V 902 to the necessary components within the control unit 202 that require 5V. Bypass capacitors 1702, 1703, 1704, and 1705 are provided in the power regulator circuit 1700 to prevent noise and fluctuations in the power supply voltage from affecting the operation of the power regulator circuit 1700.

Figures 18A, 18B:
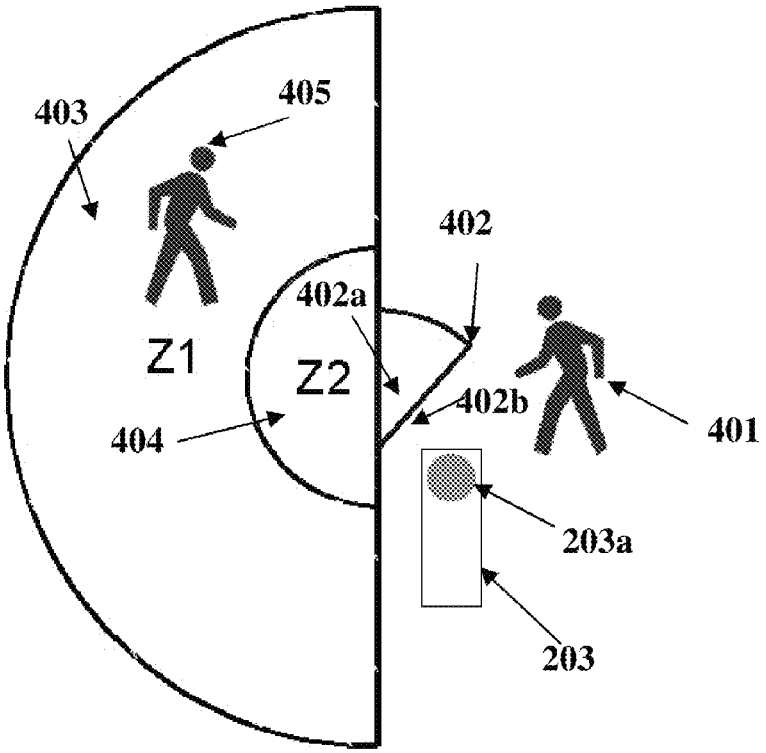
FIGS. 18A-18B exemplarily illustrate detection of an approaching object in the sensing zones established by the sensing devices and corresponding generation of an alert for indicating a possible collision between an object and a swinging barrier using a truth table.

FIGS. 18A-18B exemplarily illustrate detection of an approaching object 405 in the sensing zones 403 and 404 established by the sensing devices 201 and corresponding generation of an alert for indicating a possible collision between an object 401 and a swinging barrier 402 using a truth table. The sensing devices 201, for example, the PIR sensors 201*a*, namely, PIR 1 and PIR 2, for detecting presence of stationary objects 405, approaching objects 405, and receding objects 405 are positioned on one side 402*a* of the swinging barrier 402 in order to alert a second object 401 on the swing side 402*b* of the swinging barrier 402 of a possible collision. The indicator devices 203 comprise visual display devices 203*a*, for example, a red LED and a yellow LED and audio devices 203*b*, for example, a buzzer. The truth tables represent the activation of the indicator devices 203 based on detection of movement of the object 405 in the sensing zones 403 and 404. The audio devices 203*b* may be disabled depending on where the collision alert system 200 is used. The red LED may be turned on or may flash based on detection of movements of the object 405, for example, approaching movements and receding movements of the object 405 as disclosed in the detailed description of FIG. 4.

As exemplarily illustrated in FIG. 18A, when an object 405 enters the outer sensing zone, that is, zone 1 403 represented by Z1, PIR 1 recognizes the movement of the object 405 within Z1. The control unit 202, in communication with PIR 1, generates and transmits an alert signal to the yellow LED to light up the yellow LED on the swing side 402*b* of the swinging barrier 402. The yellow LED indicates that an object 405 has entered zone 1 403 and may be approaching the swinging barrier 402. As exemplarily illustrated in the truth table in FIG. 18B, row number 2 illustrates the above process where the activation of Z1 turns on the yellow LED. The yellow LED alerts the second object 401 on the swing side 402*b* of the swinging barrier 402 to be cautious.

Figures 19A, 19B:
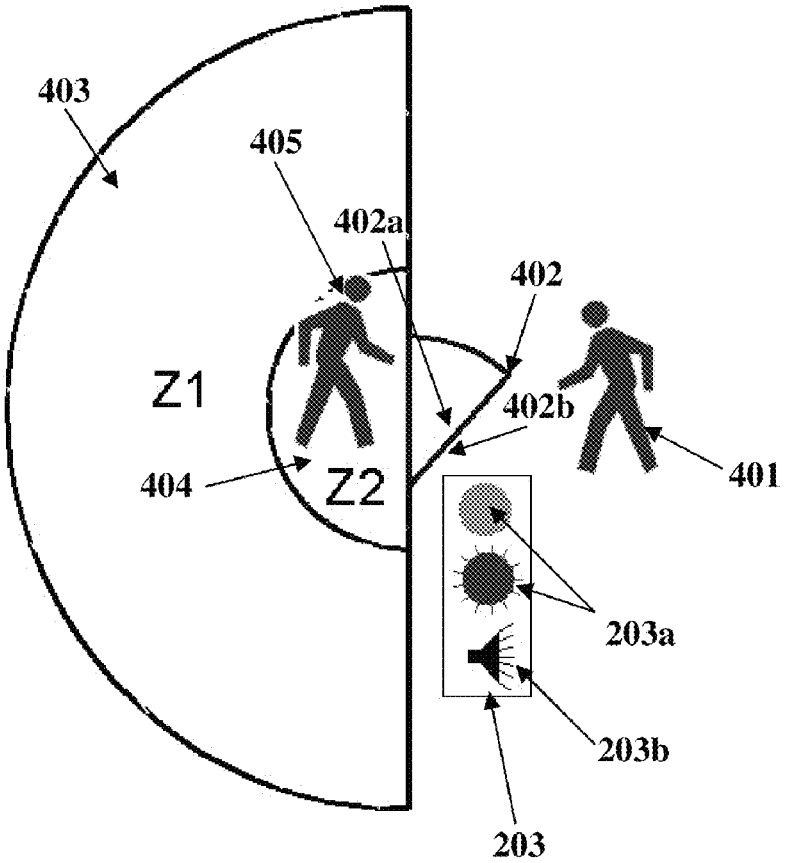
FIGS. 19A-19B exemplarily illustrate detection of approaching movements of the approaching object in the sensing zones established by the sensing devices and corresponding generation of an alert for indicating a possible collision between an object and a swinging barrier using a truth table.

FIGS. 19A-19B exemplarily illustrate detection of approaching movements of the approaching object 405 in the sensing zones 403 and 404 established by the sensing devices 201 and corresponding generation of an alert for indicating a possible collision between the object 401 and a swinging barrier 402 using a truth table. As exemplarily illustrated in FIG. 19A, when an object 405 moves from zone 1 403 to zone 2 404, PIR 1 and PIR 2 detect the motion from zone 1 403 to zone 2 404 respectively. The control unit 202, in communication with PIR 1 and PIR 2, recognizes the transition to zone 2 404 and generates and transmits an alert signal to the yellow LED, the red LED, and the buzzer, thereby lighting up the yellow LED, flashing the red LED, and activating an alarm of the buzzer to alert a second object 401 on the swing side 402*b* of the swinging barrier 402 of a possible collision within the swinging radius. As exemplarily illustrated in the truth table in FIG. 19B, row number 4 illustrates the above process where the activation of Z1 and Z2 turns on the yellow LED, the flashing red LED, and sounds the alarm of the buzzer. The transition from zone 1 403 to zone 2 404 changes the state of the collision alert system 200 from row number 2 to row number 4 of the truth table as exemplarily illustrated in FIG. 19B.

Figures 20A, 20B:
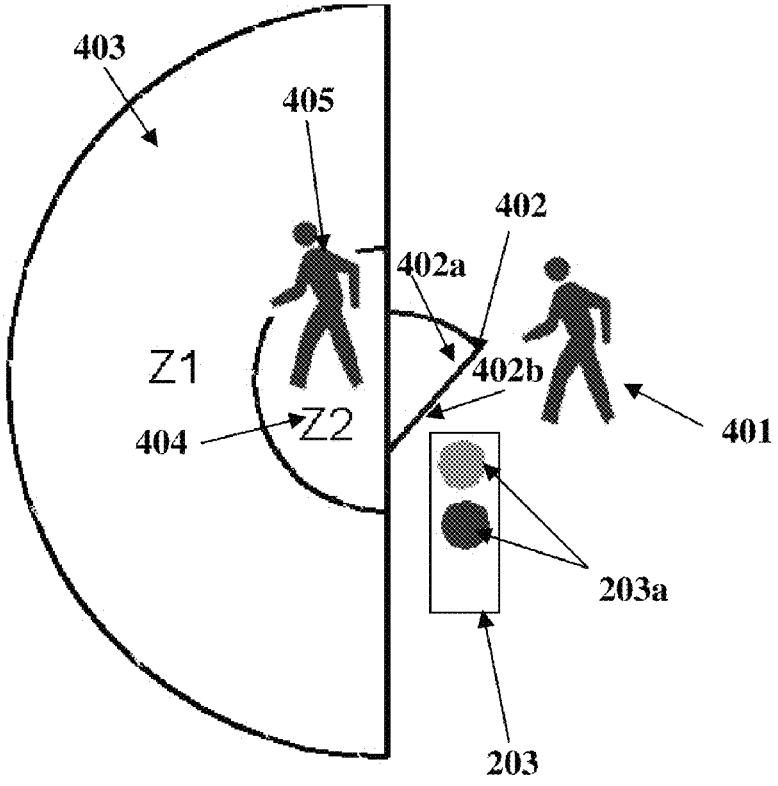
FIGS. 20A-20B exemplarily illustrate detection of receding movements of a receding object in the sensing zones established by the sensing devices and corresponding generation of an alert for indicating a possible collision between an object and a swinging barrier using a truth table.

FIGS. 20A-20B exemplarily illustrate detection of receding movements of a receding object 405 in the sensing zones 403 and 404 established by the sensing devices 201 and corresponding generation of an alert for indicating a possible collision between an object 401 and a swinging barrier 402 using a truth table. As exemplarily illustrated in FIG. 20A, when an object 405 recedes from the swinging barrier 402, PIR 2 and PIR 1 detect the motion from zone 2 404 to zone 1 403 respectively. The control unit 202, in communication with PIR 1 and PIR 2, recognizes the movement of the object 405 based on when Z1 and Z2 are activated in the truth table. When both Z1 and Z2 are activated, the control unit 202 detects the receding event and generates and transmits an alert signal to the yellow LED and the red LED to light up the yellow LED and the red LED respectively on the swing side 402*b* of the swinging barrier 402. The collision alert system 200 enters the state represented by row number 3 of the truth table illustrated in FIG. 20B. A timer is preset to detect this state. If the object 405 does not move out of both zone 1 403 and zone 2 404 within the predetermined time measured by the timer, the collision alert system 200 goes back to the state represented by row number 4 of the truth table. This indicates that the object 405 may have changed directions and did not continue on the path that the object 405 was heading, which may therefore lead to a possible collision. If the object 405 exits from zone 2 404 within the predetermined time, the collision alert system 200 enters the state represented by row number 2 of the truth table. If movement of the object 405 is detected in both zone 1 403 and zone 2 404, both the red LED and the yellow LED light up. The flashing red LED is activated to indicate the difference between an approaching movement and receding movement of the object 405.

FIGS. 21A-21Q exemplarily illustrate a C programming language implementation of the method for generating an alert for a possible collision between objects 401 and a swinging barrier 402. The clock frequency for the microcontroller 202*a* is set to, for example, 4 MHz and the data stack size is, for example, about 128. A function is defined for determining an overflow interrupt routine. FIG. 21A exemplarily illustrates initialization of variables and configuration of a recede delay time for determining a receding event or movement and an approaching event or movement. The approaching event is herein referred to as a "transition event". FIGS. 21B-21N exemplarily illustrate codes used for differentiating the presence of a stationary object 405, a transition event of an approaching object 405, and a receding event of a receding object 405 in the established sensing zones Z1 403 and Z2 404, and selectively activating the yellow LED, the red LED, a green LED, and a buzzer accordingly. FIG. 21O exemplarily illustrates codes for initialization of data direction of port pins and interrupt initialization for timers and pin change. FIG. 21P exemplarily illustrates a code listing for timer initialization. FIG. 21Q exemplarily illustrates codes for initializing peripherals of the computer system used for programming the microcontroller 202*a*.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

I claim:

1. A method for generating an alert for a possible collision between objects and a swinging barrier, comprising:

providing a plurality of sensing devices, a control unit, and a plurality of indicator devices at predetermined areas proximal to said swinging barrier, wherein said sensing devices and said control unit electronically communicate with said indicator devices;

configuring said sensing devices to establish sensing zones proximal to said swinging barrier;

detecting presence of one or more of stationary objects, approaching objects, and receding objects in said established sensing zones proximal to said swinging barrier by said sensing devices;

tracking and differentiating said presence of said stationary objects, approaching movements of said approaching objects, and receding movements of said receding objects in said established sensing zones proximal to said swinging barrier by said control unit in electronic communication with said sensing devices;

generating an alert signal by said control unit on detection of one or more of said presence of said stationary objects, said approaching movements of said approaching objects, and said receding movements of said receding objects in said established sensing zones proximal to said swinging barrier, wherein said control unit transmits said alert signal to said indicator devices; and selectively indicating said possible collision between said objects and said swinging barrier by said indicator devices based on said presence of said stationary objects, said approaching movements of said approaching objects, and said receding movements of said receding objects in said established sensing zones, on receiving said alert signal from said control unit.

2. The method of claim 1, wherein said predetermined areas for positioning said sensing devices and said indicator devices comprise an entry area and an exit area of said swinging barrier.

3. The method of claim 1, wherein said configuring of said sensing devices comprises adjusting range of sensitivity of said sensing devices.

4. The method of claim 1, wherein said configuring of said sensing devices comprises adjusting delay time for detecting said approaching movements of said approaching objects and said receding movements of said receding objects between said established sensing zones.

5. The method of claim 1, wherein said sensing devices detect said presence of said stationary objects by detecting immobility of said stationary objects within and between said established sensing zones.

6. The method of claim 1, wherein said sensing devices detect movements of objects in a predefined order for enabling said control unit to determine whether said movements are one of said approaching movements and said receding movements with respect to said swinging barrier based on said predefined order of said detection.

7. The method of claim 1, wherein said indicator devices comprise one or more visual display devices and audio devices for selectively indicating said possible collision between said objects and said swinging barrier.

8. The method of claim 1, wherein said indicator devices indicate said possible collision between said objects and said swinging barrier for a predetermined period of time based on said approaching movements of said approaching objects and said receding movements of said receding objects in said established sensing zones.

9. The method of claim 1, wherein said sensing devices establish said sensing zones by scanning a predetermined area corresponding to a swingable distance of said swinging barrier.

10. A system for generating an alert for a possible collision between objects and a swinging barrier, comprising:

a plurality of sensing devices strategically positioned at predetermined areas proximal to said swinging barrier, wherein said sensing devices are configured to establish sensing zones proximal to said swinging barrier, wherein said sensing devices detect presence of one or more of stationary objects, approaching objects, and receding objects in said established sensing zones proximal to said swinging barrier;

a control unit in electronic communication with said sensing devices and a plurality of indicator devices for processing, controlling, and monitoring said sensing devices and said indicator devices, wherein said control unit tracks and differentiates said presence of said stationary objects, approaching movements of said approaching objects, and receding movements of said receding objects in said established sensing zones proximal to said swinging barrier, wherein said control unit generates an alert signal on detection of one or more of said presence of said stationary objects, said approaching movements of said approaching objects, and said receding movements of said receding objects in said established sensing zones proximal to said swinging barrier; and said indicator devices in electronic communication with said control unit, wherein said indicator devices selectively indicate said possible collision between said objects and said swinging barrier based on said presence of said stationary objects, said approaching movements of said approaching objects, and said receding movements of said receding objects in said established sensing zones, on receiving said generated alert signal from said control unit.

11. The system of claim 10, wherein said sensing devices comprise one or more of motion sensing devices and presence sensing devices.

12. The system of claim 11, wherein said motion sensing devices are passive infrared sensors.

13. The system of claim 10, wherein said sensing devices are configured by adjusting range of sensitivity of said sensing devices.

14. The system of claim 10, wherein said sensing devices are configured by adjusting delay time for detecting said approaching movements of said approaching objects and said receding movements of said receding objects between said established sensing zones.

15. The system of claim 10, wherein said sensing devices detect said presence of said stationary objects by detecting immobility of said stationary objects within and between said established sensing zones.

16. The system of claim 10, wherein said sensing devices detect movements of objects in a predefined order for enabling said control unit to determine whether said movements are one of said approaching movements and said receding movements with respect to said swinging barrier based on said predefined order of said detection.

17. The system of claim 10, wherein said indicator devices comprise one or more visual display devices, wherein said visual display devices provide a visual indication for indicating said possible collision between said objects and said swinging barrier on receiving said generated alert signal from said control unit.

18. The system of claim 10, wherein said indicator devices comprise one or more audio devices, wherein said audio devices provide an audio indication for indicating said possible collision between said objects and said swinging barrier on receiving said generated alert signal from said control unit.

19. The system of claim 18, wherein said audio devices comprise one or more alerting beacons, buzzers, and beepers.

20. The system of claim 10, further comprising a power supply provided in a housing proximal to said swinging barrier for powering said sensing devices, said control unit, and said indicator devices.

21. The system of claim 10, wherein said sensing devices establish said sensing zones by scanning a predetermined area corresponding to a swingable distance of said swinging barrier.

22. The system of claim 10, wherein said control unit electronically communicates with said sensing devices and said indicator devices via one of a wired mode of communication, a wireless mode of communication, and any combination thereof.

* * * * *